US008550714B2

(12) United States Patent
Ben-Shushan et al.

(10) Patent No.: US 8,550,714 B2
(45) Date of Patent: Oct. 8, 2013

(54) SEALABLE ENCLOSURE

(75) Inventors: Yoav Ben-Shushan, San Francisco, CA (US); Alexander Danch, New York, NY (US); Joe Molinari, Redwood City, CA (US)

(73) Assignees: Alexander Danch, Los Angeles, CA (US); Yoav Ben-Shushan, San Francisco, CA (US)

( * ) Notice: Subject to any disclaimer, the term of this patent is extended or adjusted under 35 U.S.C. 154(b) by 358 days.

(21) Appl. No.: 12/904,895

(22) Filed: Oct. 14, 2010

(65) Prior Publication Data

US 2011/0091136 A1 Apr. 21, 2011

Related U.S. Application Data

(60) Provisional application No. 61/253,057, filed on Oct. 19, 2009.

(51) Int. Cl.
*B65D 33/16* (2006.01)
*B65D 33/25* (2006.01)
*B65D 33/18* (2006.01)

(52) U.S. Cl.
USPC ..... 383/59; 383/68; 383/78; 383/81; 24/30.5 R

(58) Field of Classification Search
USPC ..... 383/59, 68, 78, 81; 24/30.5 R
See application file for complete search history.

(56) References Cited

U.S. PATENT DOCUMENTS

| | | | | | |
|---|---|---|---|---|---|
| 296,910 | A | * | 4/1884 | Bailey | 383/34 |
| 1,712,109 | A | | 5/1929 | Hammer | |
| 1,837,918 | A | | 12/1931 | Neves | |
| 1,899,696 | A | | 2/1933 | Karnofsky | |
| 2,048,344 | A | * | 7/1936 | Lilie | 224/676 |
| 2,521,047 | A | | 9/1950 | Davis | |
| 2,606,587 | A | | 8/1952 | Porter | |
| 4,200,132 | A | | 4/1980 | Avery | |
| 4,478,330 | A | | 10/1984 | Lin | |
| 4,584,718 | A | | 4/1986 | Fuller | |
| 4,648,160 | A | * | 3/1987 | Spinosa et al. | 24/515 |
| 4,707,889 | A | * | 11/1987 | Sato | 24/30.5 R |
| 4,890,742 | A | | 1/1990 | Allison | |
| 5,079,806 | A | * | 1/1992 | Allen | 24/30.5 R |
| 5,114,061 | A | | 5/1992 | Brady | |
| 5,255,392 | A | | 10/1993 | Stanislaw | |
| 5,349,724 | A | * | 9/1994 | Bracco Barcina et al. | 24/30.5 R |
| 5,457,858 | A | * | 10/1995 | Lin | 24/511 |
| 5,542,766 | A | | 8/1996 | Cadwallader | |
| 5,592,697 | A | | 1/1997 | Young | |
| 5,617,616 | A | | 4/1997 | Cutts | |
| 5,713,108 | A | * | 2/1998 | Solomon et al. | 24/30.5 R |
| 5,797,683 | A | | 8/1998 | Gunzi | |
| 5,878,441 | A | | 3/1999 | Busker et al. | |
| 5,913,456 | A | * | 6/1999 | Dikeman | 222/95 |
| 6,082,600 | A | | 7/2000 | Angus | |
| 6,105,217 | A | * | 8/2000 | Caradine et al. | 24/501 |
| 6,105,778 | A | | 8/2000 | Tsai | |

(Continued)

*Primary Examiner* — Nathan J Newhouse
*Assistant Examiner* — Latrice Byrd
(74) *Attorney, Agent, or Firm* — Grasso PLLC; Fred Grasso

(57) ABSTRACT

A pocket closure assembly can have a pocket and a first member coupled to the pocket, where the first member has a first surface. A second member may be rotatably coupled to the first member, where the second member has a second surface that mates with the first surface to form a seal for the pocket if the second member is rotated to a closed position.

12 Claims, 23 Drawing Sheets

(56) References Cited

U.S. PATENT DOCUMENTS

| | | | | |
|---|---|---|---|---|
| 6,196,405 | B1 | 3/2001 | Kambouris | |
| 6,237,152 | B1 | 5/2001 | Gootrad | |
| 6,361,210 | B2 | 3/2002 | Denko | |
| 6,363,588 | B1 * | 4/2002 | Caradine | 24/501 |
| 6,536,589 | B2 | 3/2003 | Chang | |
| 6,578,243 | B1 * | 6/2003 | Hall | 24/501 |
| 6,659,274 | B2 | 12/2003 | Enners | |
| D489,180 | S | 5/2004 | Kramer | |
| 6,821,018 | B1 | 11/2004 | Denko | |
| 6,886,982 | B2 * | 5/2005 | Reynolds | 383/68 |
| 6,904,646 | B2 * | 6/2005 | Reynolds | 24/30.5 R |
| 6,915,934 | B2 | 7/2005 | Hassett | |
| 7,131,169 | B2 * | 11/2006 | Folkmar | 24/30.5 R |
| 7,181,806 | B2 * | 2/2007 | Folkmar | 24/30.5 R |
| 7,387,209 | B2 | 6/2008 | Ko | |
| 7,641,046 | B2 | 1/2010 | Tsang | |
| 7,647,082 | B2 | 1/2010 | Holmberg | |
| 2004/0187273 | A1 | 9/2004 | Meager | |
| 2005/0116003 | A1 | 6/2005 | Butler | |
| 2005/0247584 | A1 | 11/2005 | Lu | |
| 2007/0014491 | A1 * | 1/2007 | MacAuley et al. | 383/59 |
| 2007/0215663 | A1 | 9/2007 | Chongson | |
| 2007/0261978 | A1 | 11/2007 | Sanderson | |

* cited by examiner

SEALABLE ENCLOSURE

RELATED APPLICATION

This application claims priority to and incorporates by reference U.S. provisional application 61/253,057, filed Oct. 19, 2009 and entitled Waterproof Compartment.

BACKGROUND

1. Technical Field

Embodiments of the invention relate to enclosures or compartments, such as pouches and pockets; closures for these enclosures or compartments; and methods of manufacture. More particularly, embodiments may include sealable pockets, sealable pouches, and sealable closures; garments containing them; and methods of manufacturing the compartments, pockets, pouches, and garments.

2. Discussion

Portable enclosures are used in various applications and for various reasons. These uses can include providing for the storage of materials, retaining or grouping disparate contents, and protecting contents from external environments. Portable enclosures, such as bags and boxes, may be secured by locks, hook-and-loop fasteners, zippers, Ziploc® brand groove and furrow closures, and by various other means. In some instances, the enclosures may be small enough to carry in a concealed fashion, perhaps in a cooler or backpack. In other instances the enclosure may be much larger, requiring mechanical assistance to lift and move the enclosure about. Portable enclosures may be made from various materials.

Disclosed within the application are inventive embodiments that can comprise portable or sealable enclosures having various designs, various uses, and various methods of manufacture. In embodiments, the compartments or enclosures may be sealable and waterproof to protect internal contents. In embodiments, the compartments or enclosures may include homogenous and multi-component designs. Embodiments may have different or additional features, designs, and specifications as well.

BRIEF SUMMARY

Embodiments may include a waterproof compartment comprising a pouch, closure rails, and one or more over-clamp. In embodiments, the pouch may comprise a waterproof material and may have an opening for accessing an internal pocket defined by the waterproof material. The closure rails may be mated to a surface of the pouch and may be positioned and mated to provide access to the interval pocket defined by the waterproof material. The closure rails may be further separable along their length from a closed position, retarding fluid entry into the pocket, to an open position, allowing fluid entry into the pocket. An over-clamp may also be removably positioned around a first closure rail and a second closure rail, with the over-clamp exerting a closing force on the first and second closure rails when the over-clamp is positioned around the first closure rail and the second closure rail.

In some embodiments, the over-clamp may be pivotably connected to one or both closure rails, and an inside surface of the over-clamp may be formed as a sealing profile that mimics a sealing profile of an outside surface of a closure rail. Also, an inside surface of the over-clamp may be formed as a sealing profile that mimics a sealing profile of an outside surface of a closure rail along a portion but not the entire length of the over-clamp. In some embodiments, the over-clamp and one or both of the closure rails may have horseshoe shaped cross-sections and the closure rails may be bowed inwardly along their length towards each other. Still further, in embodiments, the sealing profile of the over-clamp may also include a ridge and a recess, with a pivot pin extending from at least one of the closure rails, and with the over-clamp being rotatably coupled to the pivot pin.

BRIEF DESCRIPTION OF THE SEVERAL VIEWS OF THE DRAWINGS

Various embodiments of the invention will become apparent by reading the specification and appended claims, and by referencing the following drawings, in which:

DETAILED DESCRIPTION

Figure 1A:
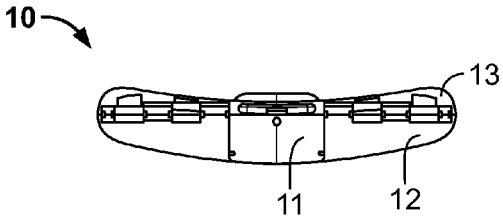
FIG. 1A shows a top view of a sealable compartment with a pouch and over-clamp in a closed position, in accordance with embodiments of the invention.

Embodiments include manufacture, processes, and devices regarding sealable compartments or enclosures. Embodiments may have numerous applications and may serve to retain contents of the compartment or enclosure and to protect contents of the compartment or enclosure from external gases and fluids. Device embodiments may comprise one or more over-clamps, a sealing gasket, a latch body and an over-cam to seal and provide access to a pocket defined by a pliable pouch. The over-cam may work in conjunction with one or more other components to generate a sealing force on the sealing gasket, such that an access opening to the pliable pouch is closed with enough force to prevent or retard the flow of fluids or gases into or out of the space defined within the pouch. In embodiments there may be two over-clamps hinged together such that they pivot about each other and in embodiments the over-cam may be positioned at or near one or both over-clamps such that the over-cam can serve to restrict movement of one or more over-clamps in a first position and not restrict movement of one or more over-clamps in a second position. In a closed position, the over-cam may meet or mate with a latch body and the latch body may be positioned in a recess of a gasket serving to seal an opening in the pliable pouch.

In embodiments the sealable compartment may employ an over-clamp and closure rails, along with a pliable pouch, for retaining contents of the compartment and for retarding or even preventing a fluid or gas from reaching the contents of the compartment. In certain embodiments, the compartment may be portable, removable, and movable form place to place and application to application. In certain embodiments, the compartment may be used as a pocket for a garment, as a compartment to store fluids or certain items, as a method for protecting the contents of the compartment from its environment, and for numerous other applications as well.

In embodiments a sealable compartment may be provided comprising a pliable pouch of waterproof material formed to include an opening for accessing the internal space defined by the waterproof material. The compartment may further contain first and second closure rails mated to a surface of the pouch, where the second closure rail opposes the first closure rail, and where the first closure rail and the second closure rail may be positioned and mated to provide selective access to the internal space defined by the waterproof material. In addition, the first closure rail and the second closure rail may be separable along their length from a closed position, retarding fluid or gas entry into or out of the pouch pocket, to an open position, allowing fluid entry into or out of the internal void. An over-clamp may also be removably positioned around the first closure rail and the second closure rail, where the over-clamp may exert a closing force on the first and second closure rails when the over-clamp is positioned around the first closure rail and the second closure rail.

Articles of manufacture and methods also fall within the scope of the invention. These manufacture and methods may be embodied in various forms including those disclosed in the specification and drawings as well as others consistent with their teachings.

FIGS. 1-6 show views of a sealable compartment in accord with embodiments of the invention. Features of the sealable compartment embodiment shown in these figures include a pliable pouch 16 having a pouch sealing profile 63, walls 51, and pouch pocket 53 within the walls 51. Over-clamps 12 and 13, and toggle clamp 11 are shown atop and over the pliable pouch 16. The over-clamps and toggle clamp may be pivotable from a closed position to an open position to allow access to the pouch pocket 53. In the closed, the over-clamp and toggle clamp may act to seal the pouch pocket and retard or prevent fluids or gases from entering or leaving the sealed pouch pocket. When moving from the open position to the closed position the toggle clamp may exhibit spring like qualities, stretching over an apex or high point of the over-clamp and snapping into a groove to secure the over-clamps together. Also shown in FIGS. 1-6 are the latch body 14, the sealing gasket 21, and the curved and straight pins 24.

Figure 6:
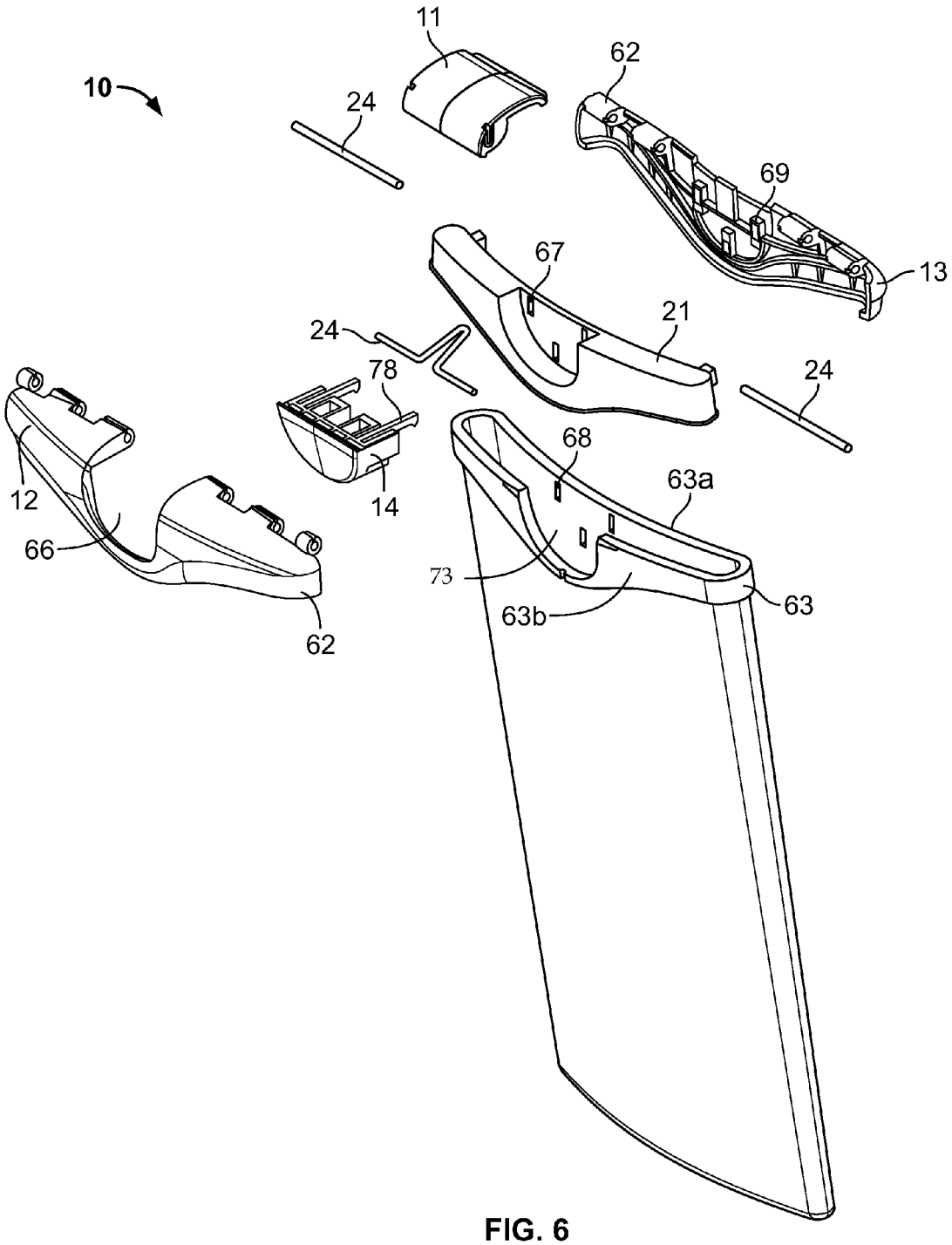
FIG. 6 shows an exploded view of a sealable compartment in accordance with embodiments of the invention.

FIG. 6 shows an exploded view of components comprising a sealable compartment in accord with embodiments. As can be seen, the latch body 14 may fit through an opening 66 of the first over-clamp 12 and an opening 67 of the gasket 21, through an opening 68 in the pouch sealing profile 63 and into an opening 68 of the over-clamp 13. When inserted all the way through the openings 68 of the second over-clamp 13, hooks on the prongs 78 may act to grasp the second over-clamp 13 and apply a force to hold the gasket 21 in contact with the back side 63*a* of the pouch sealing profile 63. Thus, the latch body 14 may be holding it, the gasket 21 and the second over-clamp 13 together. In embodiments, the opening 77 in the pouch sealing profile may be sized such that the latch body applies little or no closing forces on the front side 63*b* between the gasket 21 and the pouch sealing profile. As the pouch sealing profile may comprise flexible and pliable material, the front side 63*b* may be pulled away from or otherwise separated from the gasket 21, when the gasket is secured to the back side 63*a* and the over-clamp 13, by the latch body 14. Access to the pouch pocket 53 may be obtained by applying a separating force between the front side 63*b* and the gasket 21. The outer profile 62 of the over-clamps 12 and 13 may contour with and even mirror the shape of the pouch sealing profile 63. The contouring or mirroring may allow and provide for somewhat consistent or homogenous forces to be exerted and exchanged between the over-clamps 12 and 13 and the pouch sealing profile 63.

As can be seen, the over-clamps 12 and 13 may have a generally clam shaped design, where they pivot along a side and have an internal space between them when in a closed position. This internal space may be occupied by the gasket 21, and the sealing profile 63 of the pouch 16.

The toggle clamp 11, pins 24, and first over-clamp 12 are also shown in the exploded view of the sealable compartment 10 in FIG. 6. The toggle clamp 11 may clasp the v-shaped pin 24 while the straight pins 24 may serve to hold the over-clamps 12 and 13 together. In the closed position, the toggle clamp 11 may exert a closing force on the latch body and the over-clamp 13. This closing force may in turn be transmitted to the interface between the gasket 21 and the pouch sealing profile 63. When this closing force is exerted, the seal formed by the interface of the gasket 21 and the pouch sealing surface 63 may be water resistant or waterproof.

Figure 1B:
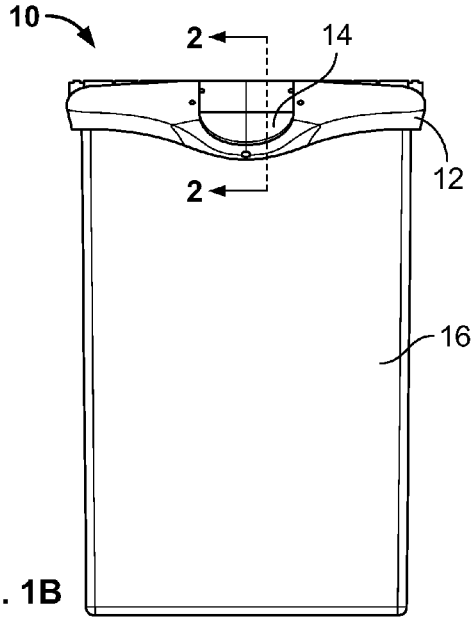
FIG. 1B shows a front view of a sealable compartment with a pouch and over-clamp in a closed position, in accordance with embodiments of the invention.
Figure 1C:
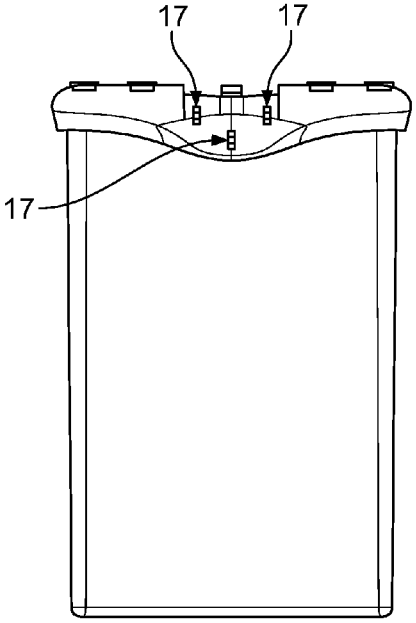
FIG. 1C shows a back view of a sealable compartment with a pouch and over-clamp in a closed position, in accordance with embodiments of the invention.
Figure 2:
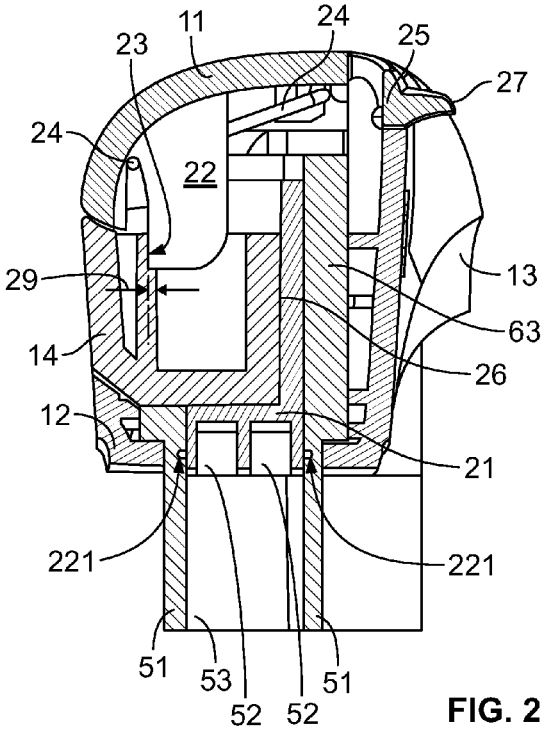
FIG. 2 shows an enlarged sectional view along line 2-2 of FIG. 1.

FIG. 2 shows a section view along lines 2-2 of FIG. 1. This section view is taken through the top portion of the sealable compartment 10 of FIG. 1 and shows the operable components of the sealable compartment in a closed position. As can be seen in FIG. 2, the toggle clamp 11 may have a lifting tab 27 and a pawl 22 that extends into the latch body 14. A locking tab 25 opposite the lifting tab 27 may interface with a notch in the second over-clamp 13. In the closed position, the toggle clamp 11 may exert compressive forces on the notch of the over-clamp 13 and on the latch body 14. These compressive forces may serve to compress or shrink the space 29 and the space 23 shown in FIG. 2. The compressive forces may also serve to urge the sealing profile 221 into the walls of the pliable pouch 16. The voids 52 of the sealing gasket may enable deformation under the compressive forces and may further enhance the seal between the gasket sealing profile 221 and the pouch sealing profile 63.

As noted, the toggle clamp 11 may have some spring action, when it is extended over the apex of the closed over-clamps, such that the toggle clamp snaps or springs back into place, into a locking position as shown n FIG. 2.

Figure 3:
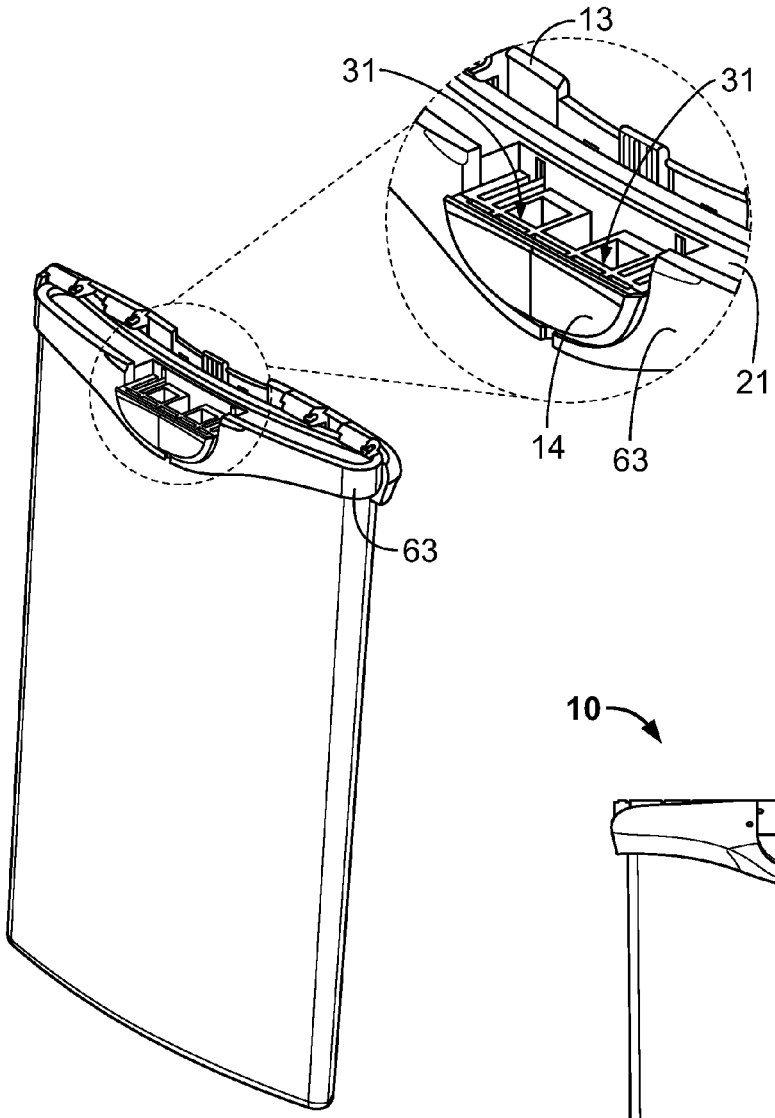
FIG. 3 is a perspective view and enlarged sectional blowup of the sealable compartment of FIG. 1A, in accordance with embodiments of the invention.

The spaces and contacts 31 in which the pawl 22 may fit are shown in FIG. 3 and the enlarged circular area. The perspective view of FIG. 3 also shows how the latch body, sealing gasket 221, pouch sealing profile 63 and over-clamp may be positioned next to each other and aligned when the latch body 14 is inserted in the alignment openings.

Arms of the V-shaped pin 24 may be secured to the sockets 17 shown in FIG. 1C. The V-Shaped pin may serve to provide a positive locking force when the toggle clamp 11 is snapped shut into a closed position.

Figure 4:
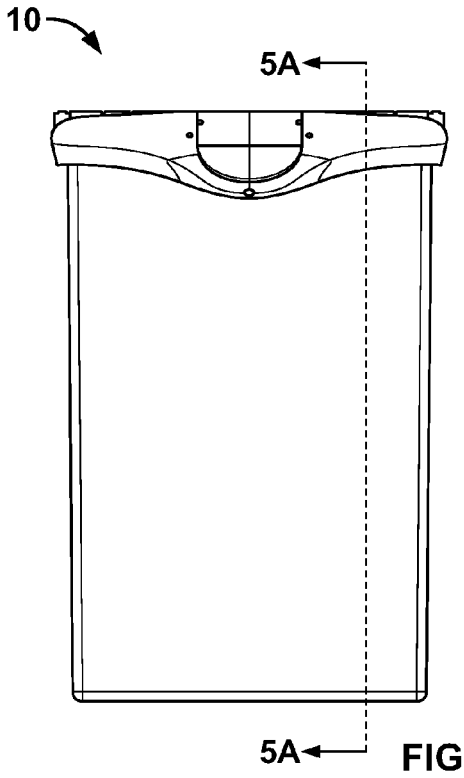
FIG. 4 shows a front view of the sealable compartment of FIG. 1 in accordance with embodiments of the invention.
Figure 5A:
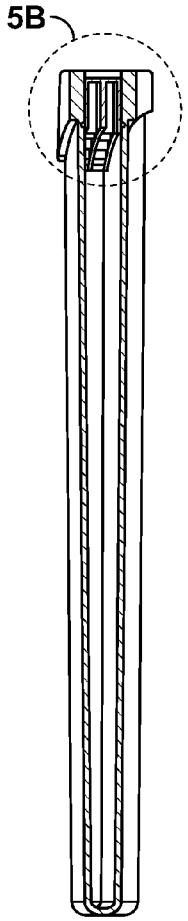
FIG. 5A shows a sectional view taken along line 5-5 of FIG. 4, in accordance with embodiments of the invention.
Figure 5B:
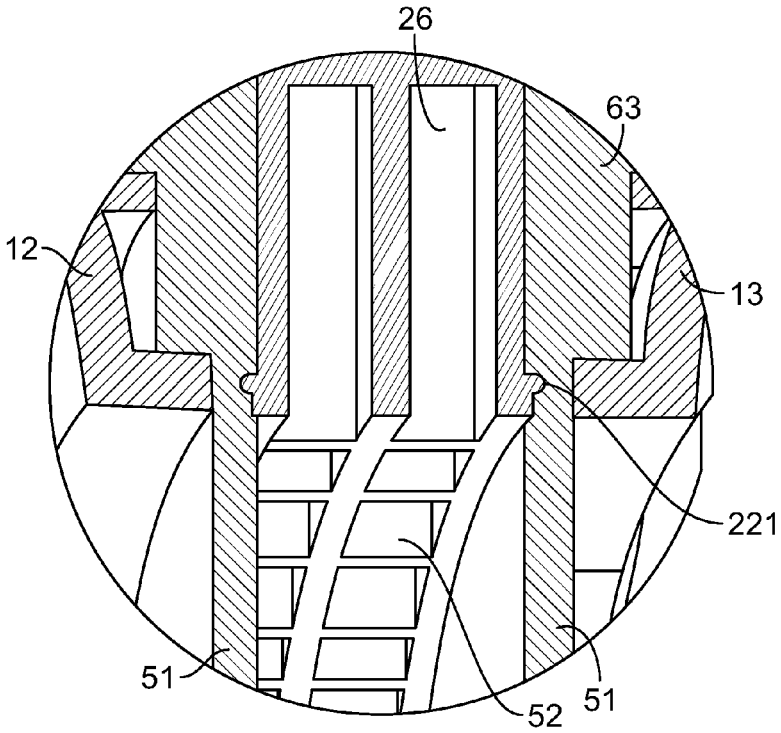
FIG. 5B shows an enlarged blowup of the circled area of the sealable compartment of FIG. 5A, in accordance with embodiments of the invention.

FIG. 5B shows the enlarged circular area of profile section 5-5 of FIG. 4. Visible in this enlarged section are the pouch sealing profile 63, the over-clamps 12 and 13, and the sealing gasket 221. Also visible is the manner in which these components may be configured and may mate with one another. For example, the sealing profile 221 of the gasket is shown in the form of an o-ring and the pouch wall 51 is shown having a recess formed to receive the o-ring extension. The voids or sealing compression zones 52, which are rectangular in this embodiment, are also shown. These voids may provide for adequate resiliency and flexibility while compressive loads are applied to hold the sealable compartment in a closed position. Larger voids may provide for more flexibility while smaller void spaces may provide for more rigidity. The sealing profile may have a profile to allow for gripping to assist in opening the pliable pouch to allow access to the pouch pocket.

The gasket in this and other embodiments may be formed injection molding techniques as with the pliable pouch. Materials, such as polypropalene, with glass spheres, may be used for material comprising the gasket and the pliable pouch. Nylon may also be employed, as well as other materials. Versaflex is an exemplary thermoplastic polymer that may be used for the pliable pouch and gasket.

In embodiments the pliable pouch may have a nominal wall thickness of between 0.03 inches and 0.04 inches and the wall material may further have a durometer of approximately 50 to 60 ShoreA. The wall may be preferably resistant to skin oil, sunscreen, and skin lotions, as well as preferably resistant to chlorine, salt and freshwater. The walls may also be preferably stable when exposed to sunlight and UV rays, resistant to detergents and to dryer conditions. Other dimensions and materials may be used as well.

The pliable pouch may also be made from elastomers that are melted during production. Versa Lex is an example of an appropriate elastomer and may be used in embodiments. In addition to the polypropylene described in various components of embodiments of the portable sealable sealable enclosure, nylon may also be used.

During manufacture, the pliable pouch may be over molded over certain products to be controlled and stored in the pliable pouch such that the pliable pouch may be contoured to a mimic the product. As described herein, the pliable pouch may provide for connections with the product placed in the pouch.

In embodiments the gasket may be an elastomeric material that is pressed into the pliable pouch material. The nominal wall thickness of the gasket may be preferably 0.04 inches and the material of the gasket may also be resistant to skin oil, sunscreen and skin lotions as well as to chlorine, regular and salt water. Material forming the gasket may also be stable when exposed to sunlight and UV resistant. Other dimensions and materials may be used as well.

In embodiments, the latch body may be employed to serve two functions. The first may be to assemble the pocket to the over clamps, as described above. The second may be to hold the gasket and pouch sealing profile and over-clamp together. The latch body may also provide a surface for the toggle clamp to catch onto the latch body in a closed position. In this closed position, the clamping force generated may provide or generate a watertight seal.

The over clamps in embodiments may provide a clamping forces for the front and rear of the pliable pouch material. In embodiments the over clamps may be light and have a nominal wall thickness of approximately 0.06 inches. As with earlier above-described components, the over clamps may also be resistant to oil, sunscreen, chlorine, salt water, and fresh water, and may be stable when exposed to sunlight and UV rays. The over-clamps may also be resistant to detergents and dryer conditions.

In embodiments, the over-clamps, latch body, and toggle clamp may be made from polypropylene. The pliable pouch material and the sealing gasket, on the other hand, may be made from alcryn.

In embodiments, the polypropylene may be supplied by RTP Company. In embodiments the alcryn may be provided by APA company (Advanced Polymer Alloys).

The Alcryn may be an LCR and MPR from the various series offered by APA, including the 1000, 2000, 3000, and 4600 series product lines. As with each of the embodiments described herein, other materials and dimensions may be used as well.

In embodiments, a portal sealable enclosure may be integrated into clothing by gluing as well as by stitching. Embodiments may also be employed in other environments, including storing medical devices.

Figure 7:
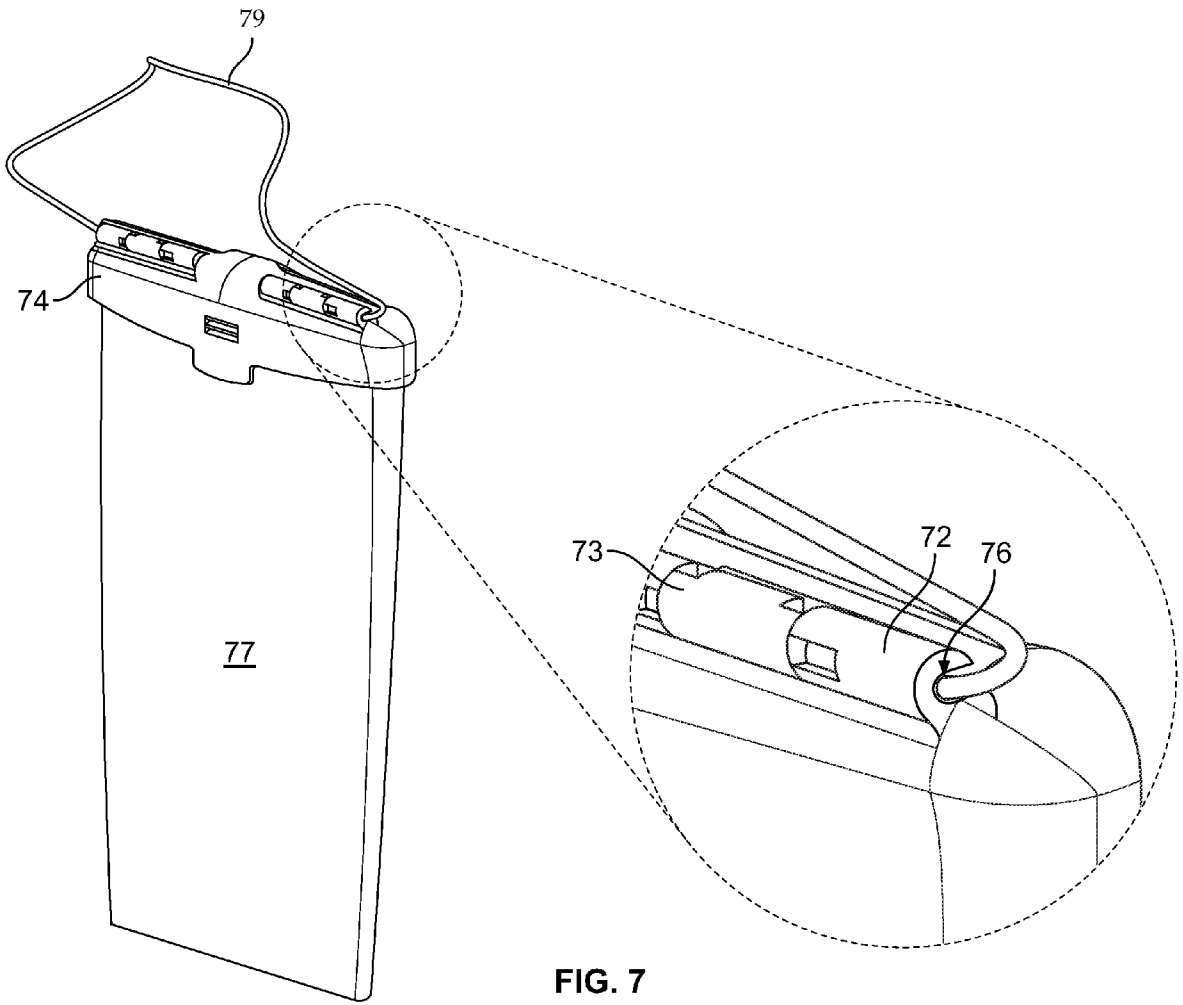
FIG. 7 shows a side perspective view of a sealable compartment and an enlarged blowup of the hollow hinge of the over-clamp in accordance with embodiments of the invention.

FIG. 7 shows a sealable compartment, also in accord with embodiments. As can be seen, the over-clamp 74 has a different configuration and has a hollow hinge 72 and 73, holding its sections together. This hollow hinge may allow a chord 77 or some other material to pass through, to facilitate carrying the compartment or for some other reason as well. The hollow hinge opening 76 is shown in the enlarged portion of FIG. 7. A pin may be resident in the hollow hinge, the pin also being hollow.

FIGS. 8-12 show features and sections and components of a sealable compartment in accord with embodiments of the invention. As with each of the embodiments provided herein, features and aspects of each embodiment may be removed, added and exchanged between them and with other features as well while remaining within the spirit and scope of the invention.

Figure 8A:
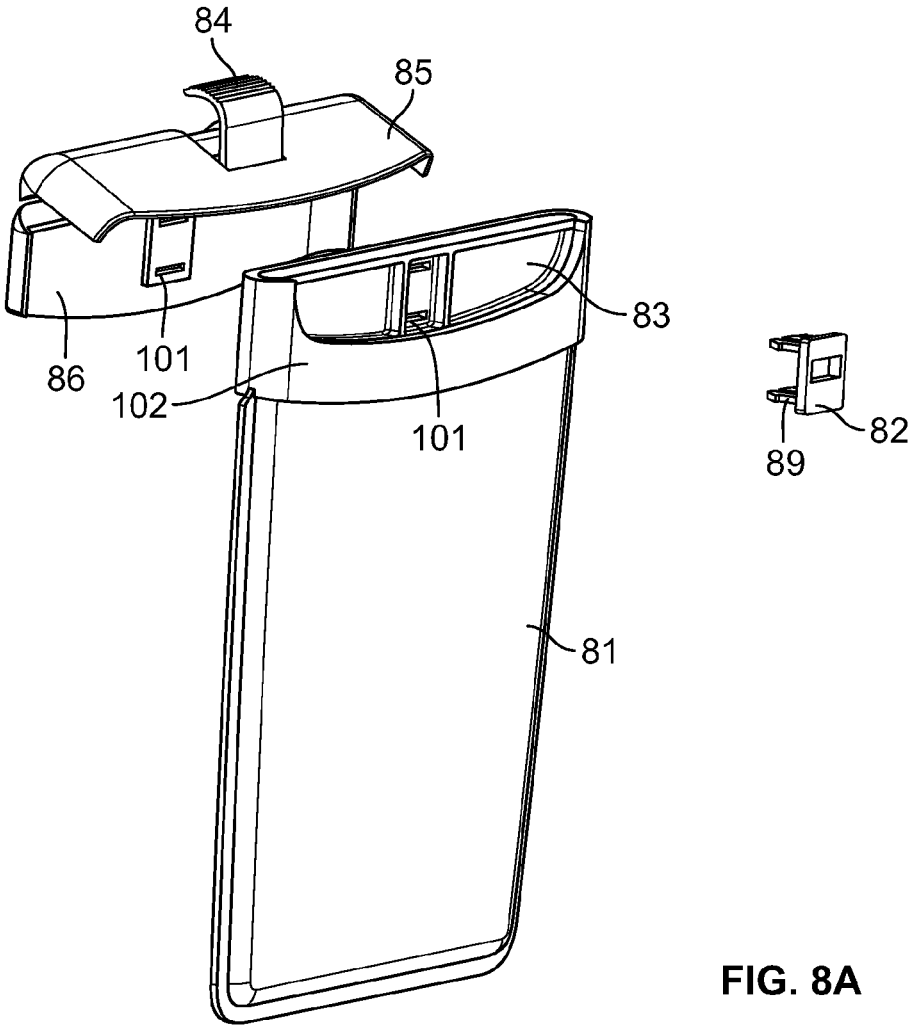
FIG. 8A shows a partially exploded perspective view of a sealable compartment in accordance with embodiments of the invention.

FIG. 8A shows an exploded view with the toggle clamp 84 and over-clamp 85 in an open position. The latch body 82, with prongs 89 is shown aligned with the alignment openings 101 of the second over-clamp 86 and the sealing gasket 83. As with the earlier embodiment, the pouch sealing profile 102 contains a recess 103 shaped to conform with the outer profile of the sealing gasket. Lines 88 of FIG. 8C show how access may be obtained to the pocket of the pliable pouch 81. These lines 88 show a separation pattern between the pouch sealing profile 102 and the sealing gasket 83. Also visible in FIG. 8C is the pawl 87 of the toggle clamp 84. This pawl 87 may exert a force on the latch body 82 when the sealable compartment is in a closed position.

Figure 8B:
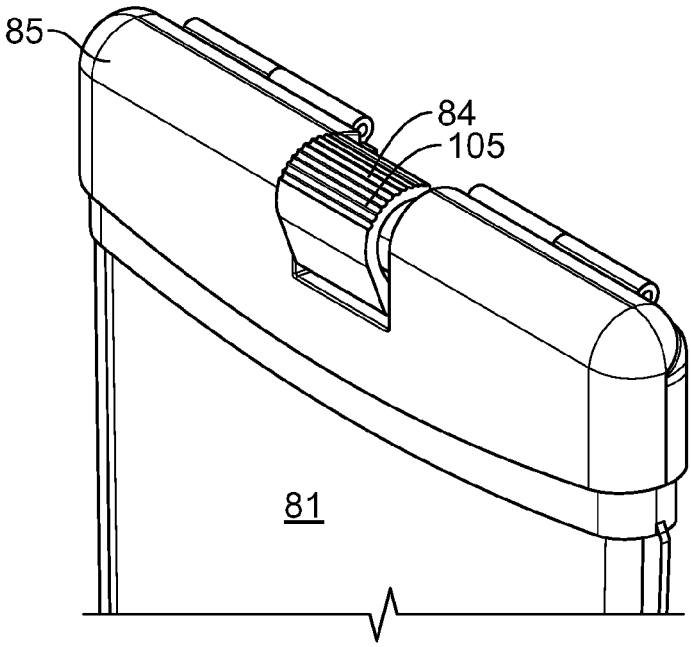
FIG. 8B shows a perspective view of an unlatched over-cam of a sealable compartment in accordance with embodiments of the invention.
Figure 8C:
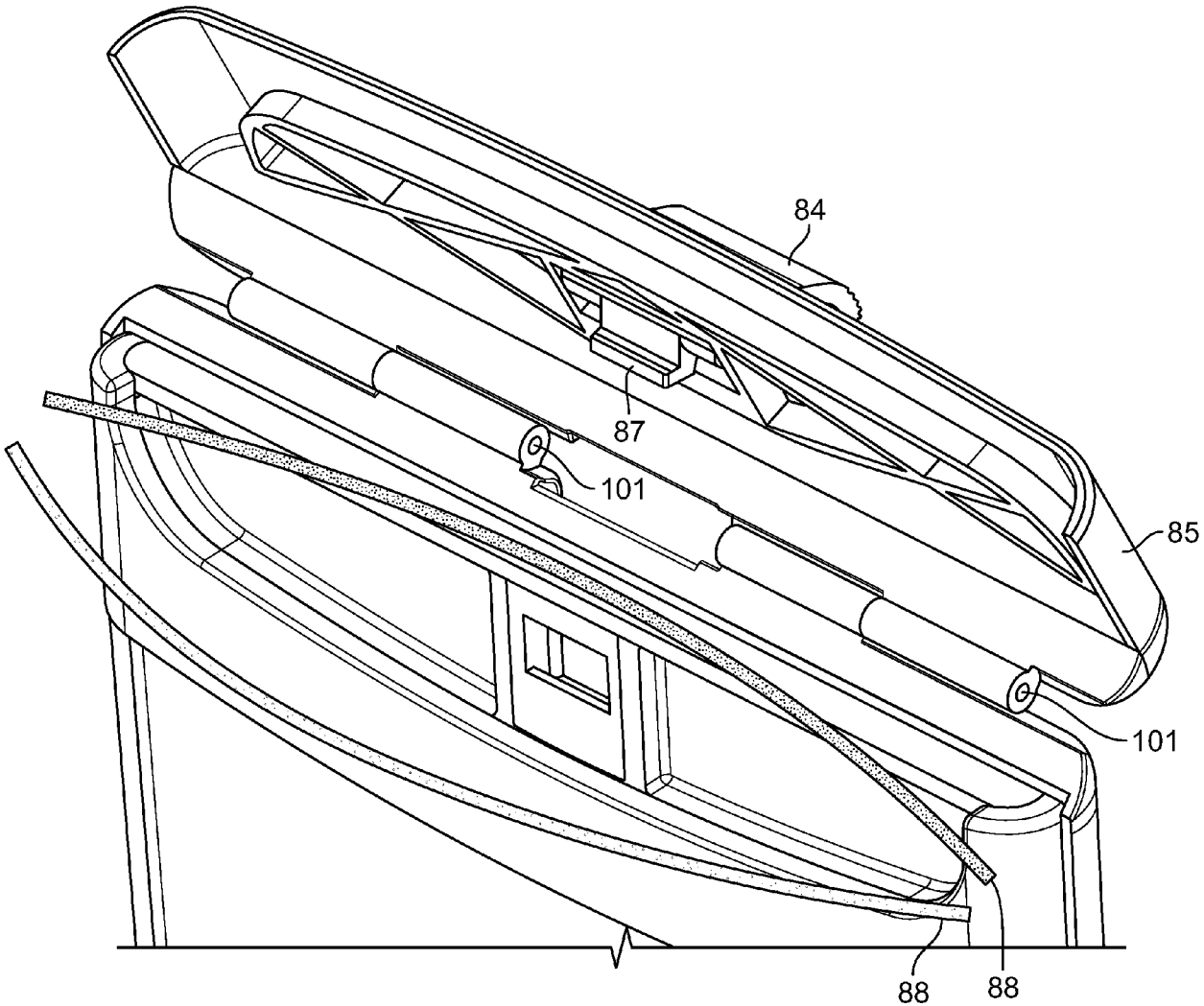
FIG. 8C shows a perspective view of an unlatched over-cam and an open overclamp of a sealable compartment in accordance with embodiments of the invention.

FIG. 8B shows the notches 105 that may be present on an exposed surface of the toggle clamp 84. These notches may facilitate single-handled opening and closing of the toggle clamp 84, from an open to a closed position. Reinforcement ribs 124 within the over-clamp 85 are visible in FIG. 8C. These ribs may be configured to reinforce the over-clamp 85 and also to apply sealing pressure to the gasket 83. As can be seen in FIG. 8C, the ribs 124 may have an extended or outer form that conforms with or mirrors the shape of the gasket 83. In this embodiment, the shape mimics an elongated "D" pattern that mimics the shape of the gasket recess and the gasket 83. The pins 101 are also visible in FIG. 8C. These pins 101 serve to hold the mating over-clamps 85 and 86 together and to allow them to pivot about each other.

Figure 9B:
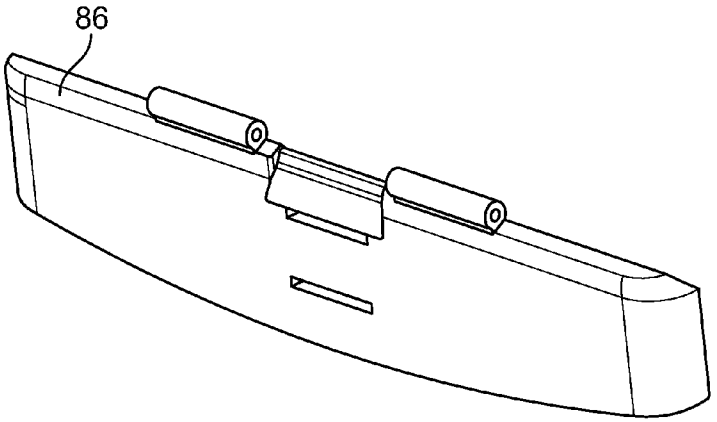
FIGS. 9A-9F show perspective views of components of a sealable compartment in accordance with embodiments of the invention.
Figure 9C:
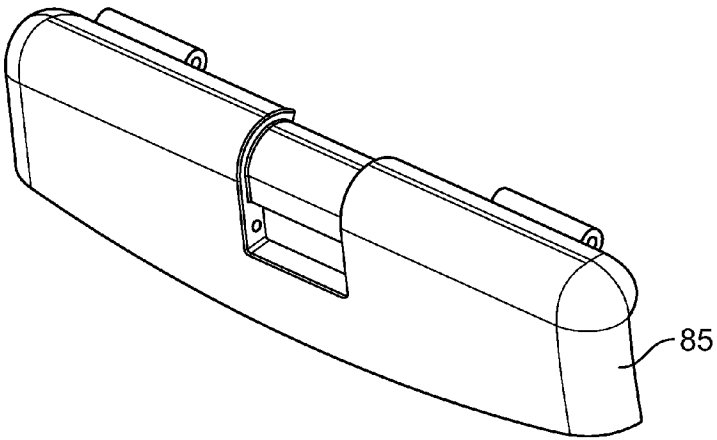
Figure 9A:
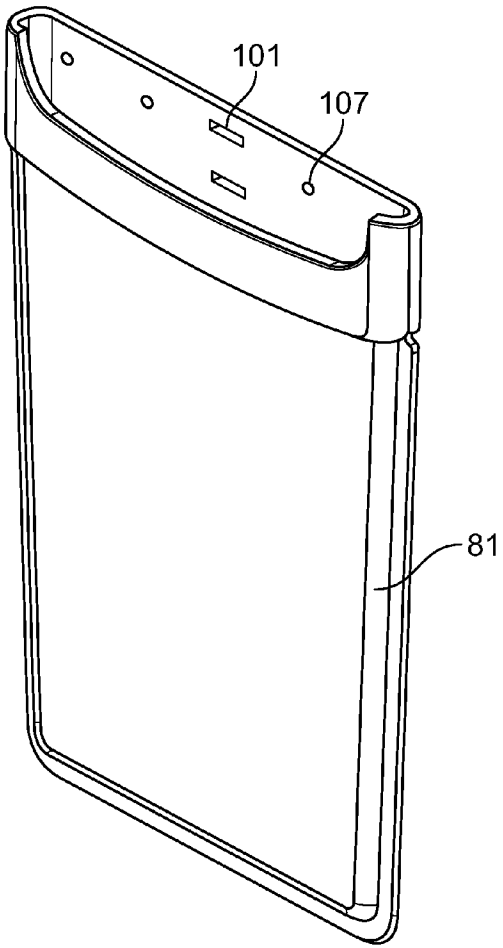
Figure 9F:
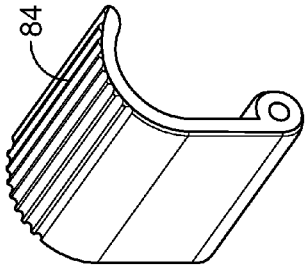
Figure 9E:
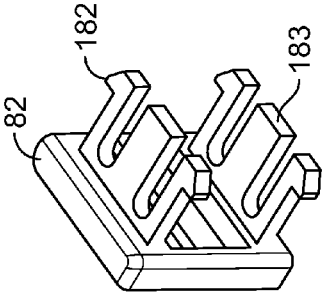
Figure 9D:
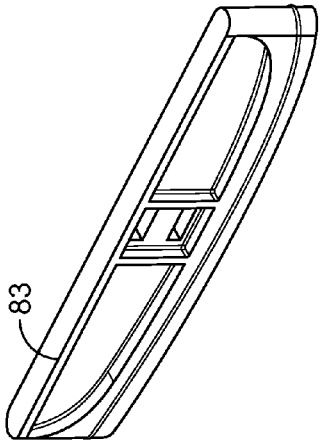
Figure 10:
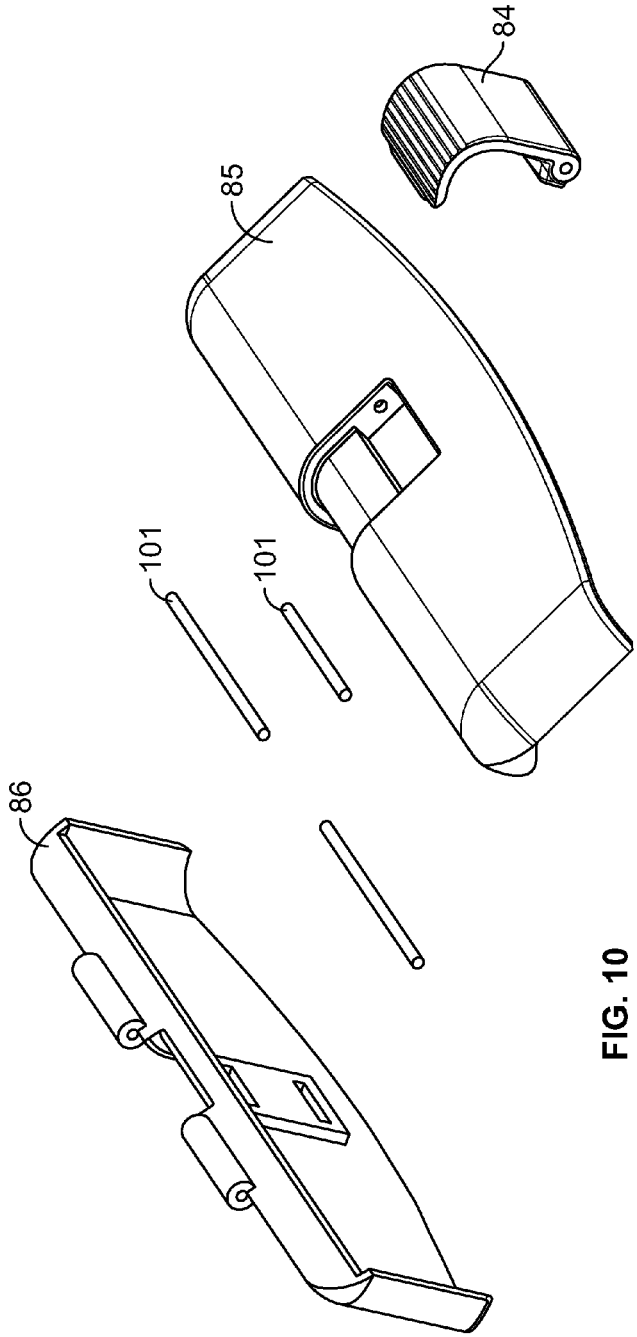
FIG. 10 is an exploded view in accordance with embodiments of the invention.

Perspective views of components of the sealable compartment are shown in FIGS. 9-10. The alignment openings 101 and 107 are shown in FIG. 9A. The alignment openings 107 may be positioned and sized to accept prongs from the latch body while the alignment openings 101 may be positioned and sized to accept prongs from the gasket 83. The alignment openings may be spaced evenly or uniformly across the pouch sealing profile 102 to allow for uniform force transfer. The sealing surface 108 of the gasket 83 is shown in FIG. 9D. This sealing surface may interface or touch the inside surface of the pouch sealing profile 102 and may be compressed against the inside surface when the sealable compartment is in a closed position.

The latch body 82 is shown in a perspective view in FIG. 9E. As can be seen, the prongs of the latch block may terminate in hooks 182 or may be in the shape of a blade 183. The length of the prongs on the latch block may be such that when the hooks extend through the openings 101, the hooks 182 may create a compressive force, pulling the gasket 83 against the inside surface of the pouch sealing profile 102.

FIG. 10 shows how the pins 101 maybe used to hold the over-clamps 85 and 86 together and to also rotatably secure the toggle clamp 84 to an over-clamp.

Figure 11A:
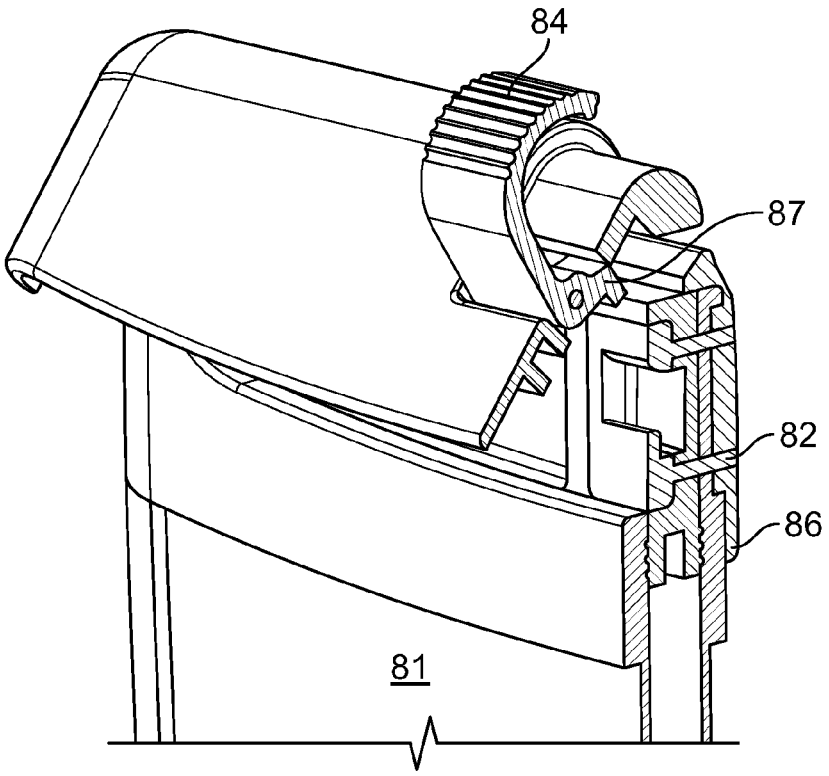
FIGS. 11A-11G show enlarged perspective views of sections of the operable portion of a sealable compartment in accordance with embodiments of the invention.
Figure 11B:
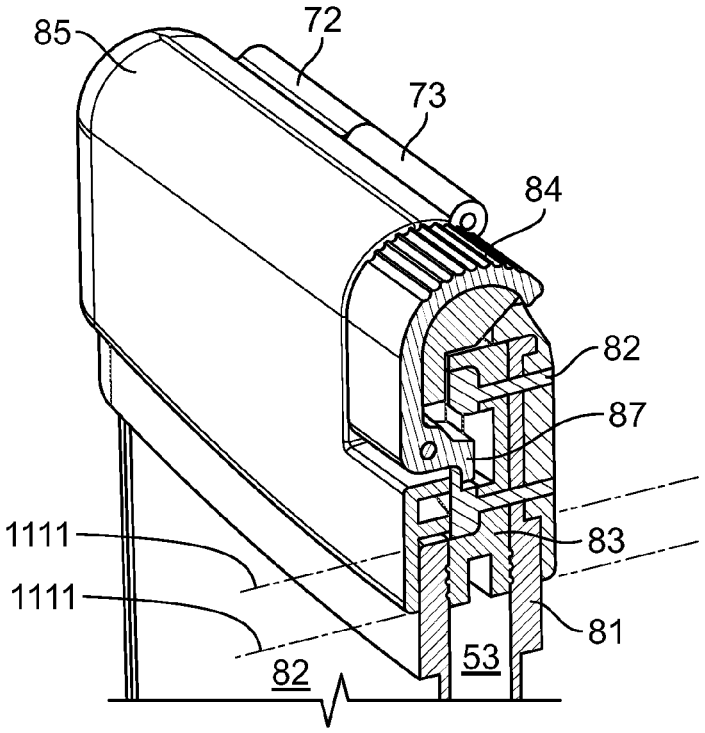
Figure 11D:
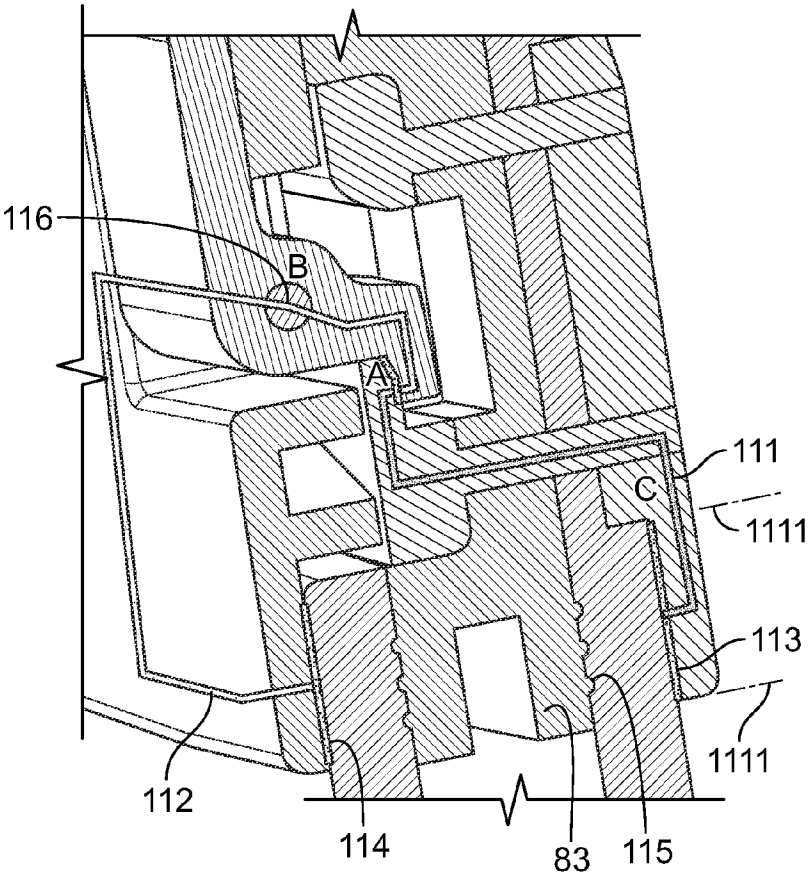
Figure 11C:
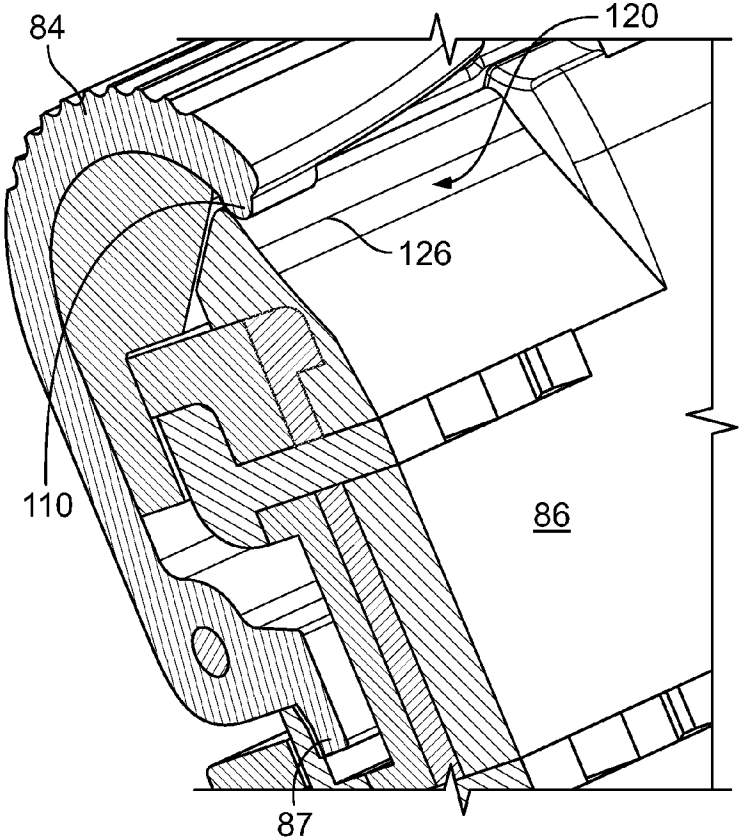

FIGS. 11A-11G show enlarged sectional and perspective views of components of sealable compartments in accord with embodiments of the invention. FIG. 11A shows the toggle clamp 84 in an open position while FIG. 11*b* shows the toggle clamp in a closed position. As can be seen, the pawl 87 of the toggle clamp 84 presses on the latch body 82. This pressure pulls the over-clamp toward the pawl 87 and creates a sealing force. The locking knob 110, which seats in grooves 126 of the over-clamp, is shown in FIG. 11C. Because multiple grooves 126 are present on the surface of the over-clamp, the amount of compressive force generated by the toggle clamp can be increased by positioning the locking knob 110 in different grooves 126.

Figure 11F:
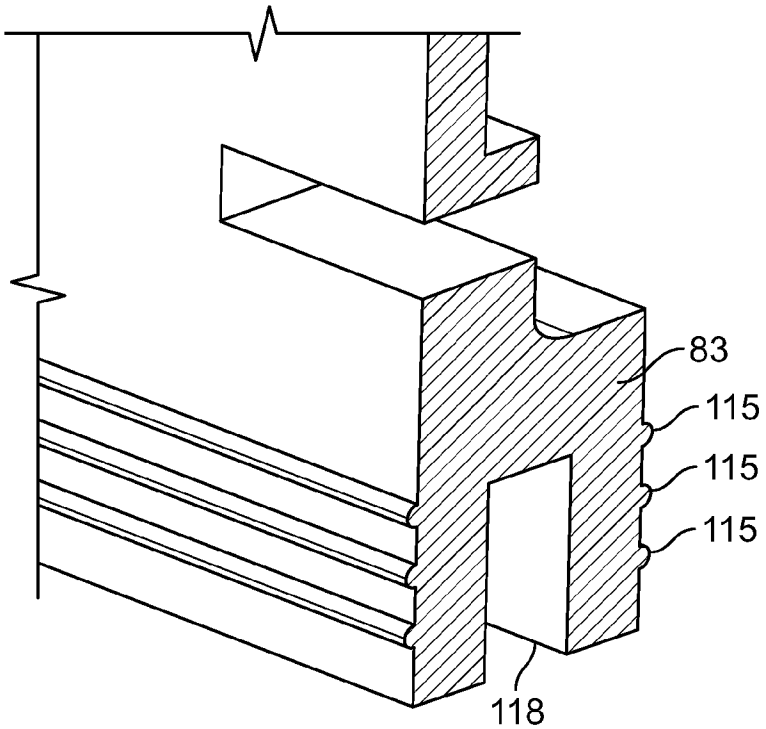

FIG. 11D shows force lines 111 and 112 and how those forces are applied to sealing surfaces 113 and 114 as well as to sealing profile 115. Pivot pin 116 is labeled in FIG. 11D as well. FIG. 11F shows the sealing gasket 83 and its sealing profiles 115 as well as the compression zone 118. As compressive forces 111 and 112 are applied towards sealing profile 115, the compressive zone 118 may be compressed and a water-proof seal may be created against sealing profile 115. This seal may be water-proof to 3 atmospheres of pressure or more.

FIGS. 11A-11D show a clamp and closure zone a sealing zone and a pocket zone as may be employed in embodiments. The closure zone may include the interaction between the pawl 87 and a latch body 82. The sealing zone which is shown by lines 1111 in FIG. 11D may include the interfaces between the gasket 83 and its sealing profiles 115 with a sealing surface 114 of the pliable pouch 81. FIG. 11D. shows the sealing zone again with lines marked 1111. The pocket zone for pouch pocket is shown below the client exhausting the sealing zone in FIG. 11B. The pouch pocket is labeled with number 53 in FIG. 11B. As can be seen, components above the sealing zone in the clamp and closure zone are susceptible to water entry into exposure to water or other fluids or gases however, because of the compressive forces place and the sealing zone the water in or gases would not pass from the clamp and closure zone through the sealing zone to the pocket zone or the pouch pocket 53.

FIG. 11 C. show the locking knob 110 in a series of grooves 126 on the over-clamp 86 as the locking knob extends to each of the grooves, the toggle clamp 84 exerts greater force through the pawl 87, onto the latch body 82. In embodiments, as forces increase the compressive force in the sealing zone increases as well. In embodiments the ability of the toggle clamp 84 to stretch and hold positions in the groove 120 allows for additional compressive force and an additional sealing force to be placed in the sealing zone.

FIG. 11 D. shows the forces generated and transferred between the toggle clamp 84 and the latch body 82 through and into the sealing surface 114 sealing profile 115 and the sealing surface 113.

Figure 11E:
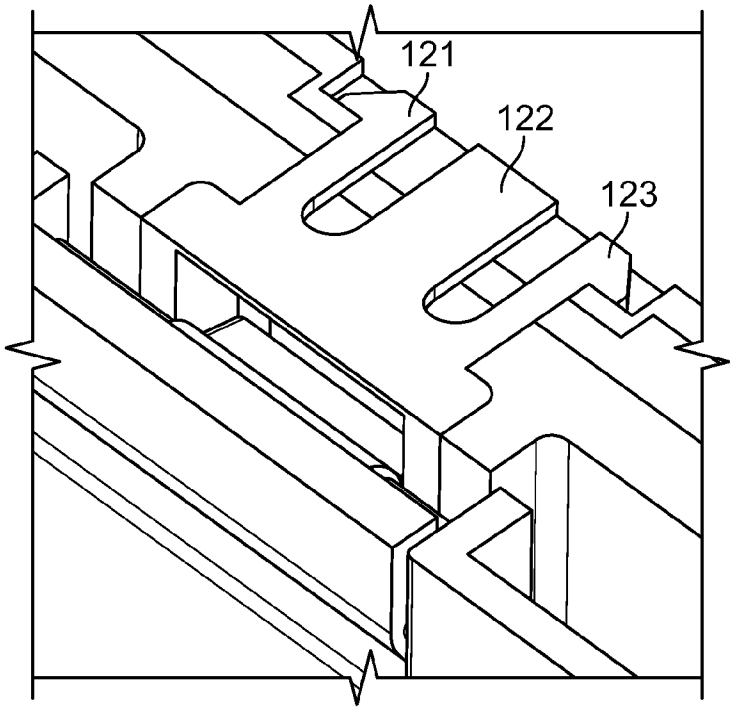
Figure 11G:
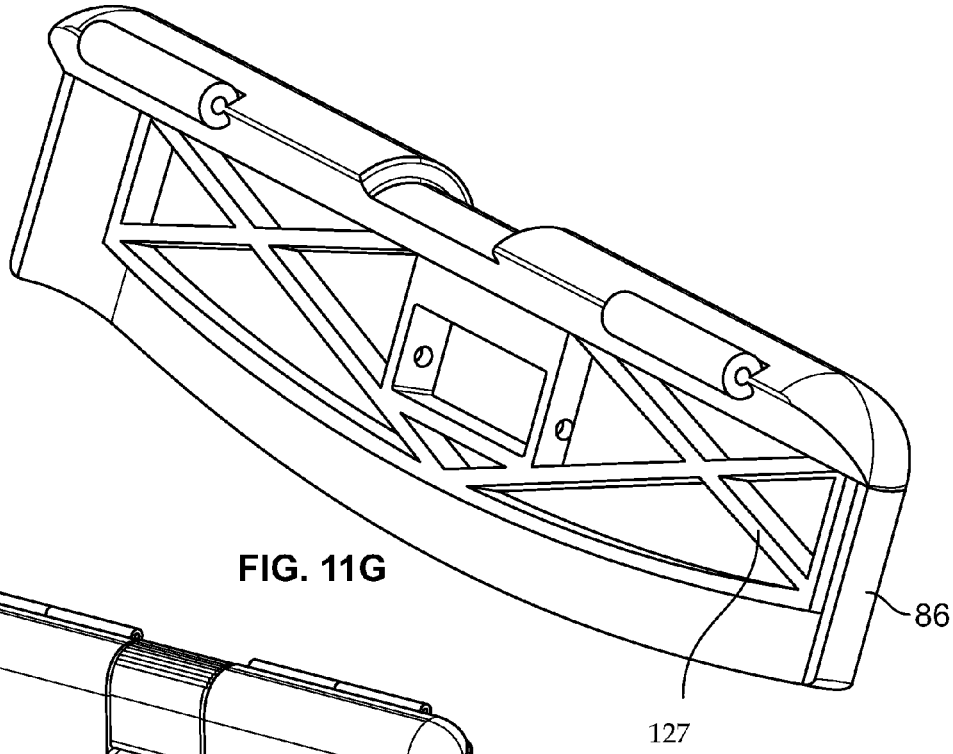

FIG. 11E shows the prongs 121 and 123 and the blade 122 of the latch body as may be employed in embodiments. As can be seen, prongs contain hooks that serve to grasp onto the outermost over clamp such that the gasket pouch sealing profile and over clamp can be held firmly together. Comparatively, the blade may be straight and used for alignment. In embodiments, rather than using the snap prongs, which extend through and are pulled back, other attachment mechanisms may be used to attach the gasket over clamp and pouch sealing profile. These may include adhesives and plastic welding, which are more permanent connection schemes as well as other mechanical connection schemes that may be both assembled and disassembled.

Sealing in the various embodiments may be achieved through the application of clamp forces and the design of the interface between the liner and the gasket. In embodiments the liner and O-ring feature may conform to each other, to provide a sealing interface. In FIG. 11F the sealing profiles and raised ridges are shown him other exact sealing details may also be provided in various embodiments. Also, the size and shape of the compression zone 118 may also change, depending upon the compressive forces being applied and the materials being interface with. In embodiments, the sealing profiles may extend around the entire outer surface of the gasket 83.

Figure 12:
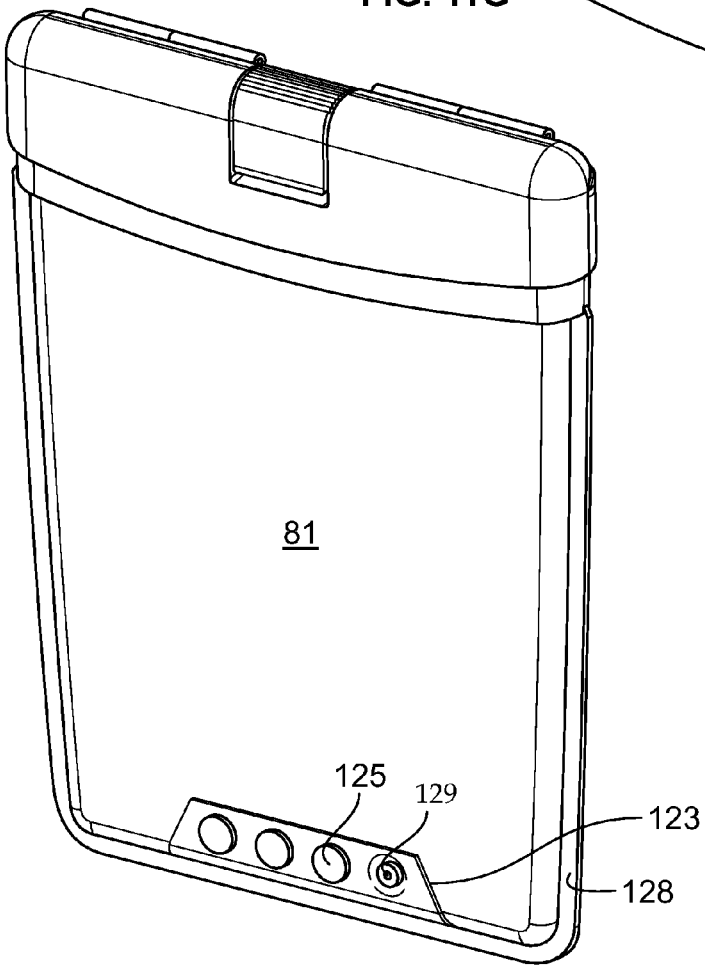
FIG. 12 shows a front perspective view of a sealable compartment in accordance with embodiments of the invention.

FIG. 12 shows that the pliable pouch 81 may have sealable openings and attachments in embodiments. A control panel 123 is shown at the bottom of the pliable pouch 81 in FIG. 12. This control panel 123 may have a sealable opening 124, to allow selective access within the pliable pouch and may also have control buttons to enable control of devices within the pliable pouch. In embodiments, wires controlling electronic devices may be fed through one or more connection ports 124 of the control panel. The connection ports may provide for electrical connections on the inside and the outside of the pliable pouch. The connection port may also provide for a sealed penetration of the pliable pouch, with a gasket serving to seal around wire passing through the port. These wires may be associated with receiving or sending data to electronic devices within the pouch and for other reasons as well. The control buttons may also be used to control devices within the pouch as well as to send and receive data. Other interface adaptors may also be used depending upon the needs of the device within the pouch.

In embodiments the pliable pouch and the gasket may be each molded from a thermoplastic elastomer. The pins, make may preferably be made from stainless steel or from other of rigid low friction materials.

As described above, the reinforcing ribs may be formed directly as part of the over clamp in order to provide reinforcement of the over clamp and in embodiments to provide additional sealing forces on the gasket body over clamp. As shown in various figures as the toggle clamp may have a serrated top to allow for gripping and during closure and opening operations. Other tactile services may be employed as well.

Figure 13:
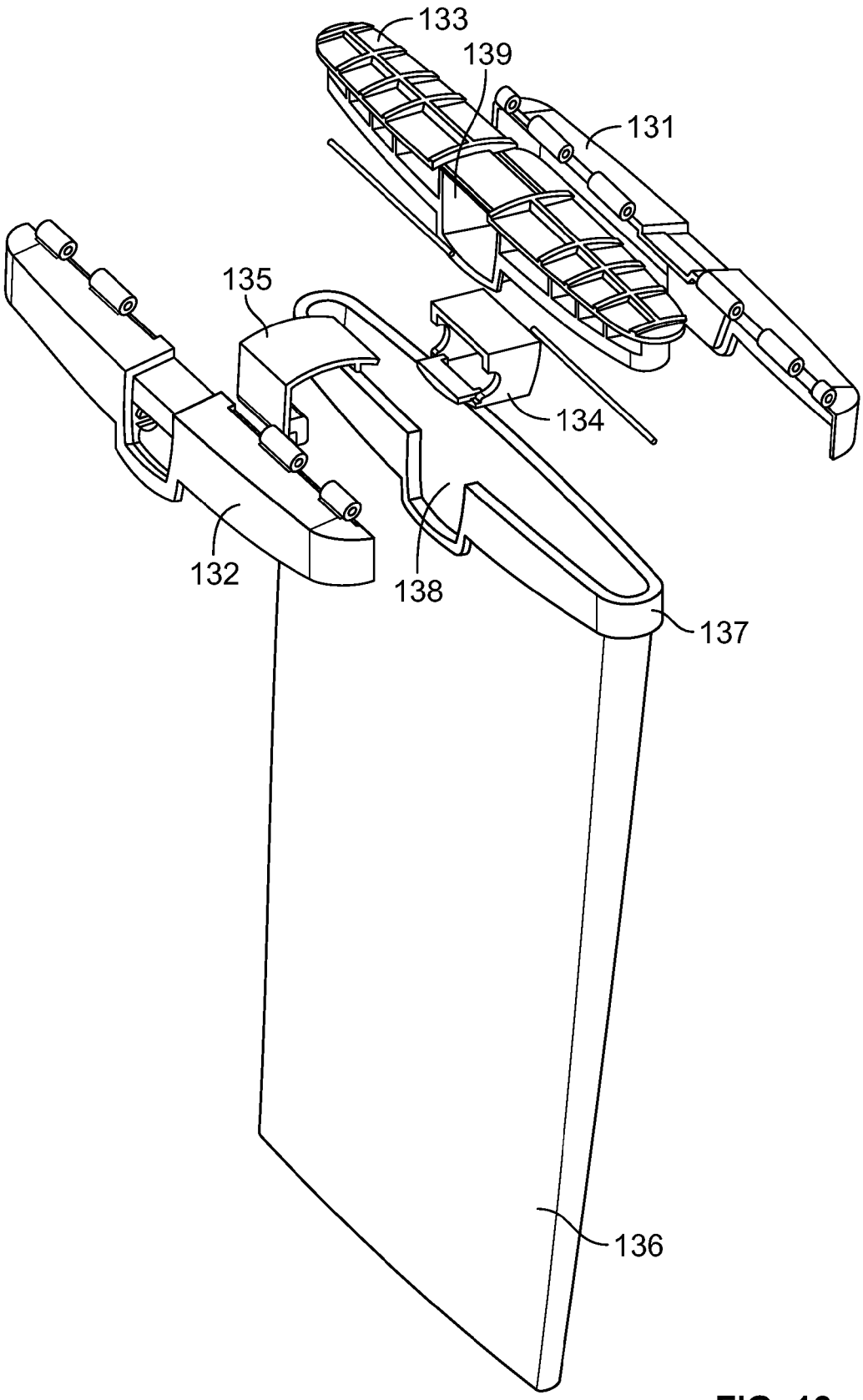
FIG. 13 shows an exploded perspective view of components comprising a sealable compartment in accord with embodiments of the invention.

FIG. 13 shows embodiments of the present invention. As can be seen in FIG. 13 the sealable compartment may include over clamps 131 and 132, a sealing gasket 133, a latch body 134, toggle clamp 135, and the pliable pouch 136. The pliable pouch 136 may include a pouch sealing profile 137 with a sealing profile notch 138. The over-clamps may contain hinges connecting the two together, in this embodiment. The sealing gasket 133 in this embodiment has a fully bordered recess 139 in which the latch body 134 may be placed and inserted through. This recess 139 is also sized to align with the sealing profile notch 138 of the pliable pouch 136. This recess 139 may mimic the size and shape of the latch body 134.

FIGS. 14A, 14C, and 14D 10A shows a sealable compartment 1410 having a pouch or pocket 1411, an over-clamp 1412, and closure rails 1415 having a gripping region 1444 and 1446 for ease of handling. Consistent with the other examples and teachings provided herein, the waterproof compartment 1410 can be used in a number of water-based activities such as swimming, snorkeling, scuba diving, surfing, water skiing and jet skiing, to protect a wide variety of items such as watches, cell phones, personal digital assistants (PDAs), media players, sensitive devices, medical devices, therapeutics, and medications from water damage. As with the above, the compartment 1410 may be sewn, stitched, welded or otherwise incorporated into a garment such as swimwear or a wet suit, or carried separately by the individual in a pre-existing pocket or other water-permeable closure. Other methods of transport and use may also be used.

In this illustrated example, the closure rails 1415 may be coupled to a pocket or garment, wherein the closure rails 1415 may generally have a sealing profile 145 that mates directly with a sealing profile of the over-clamp 1412 to form a water resistant seal for the compartment if the over-clamp 1412 is rotated to a closed position as shown. Accordingly, items placed within the compartment 1410 can be kept safe from water damage. Additionally, the illustrated compartment 1410 may be sturdy, and easy to open and close.

Figure 14A:
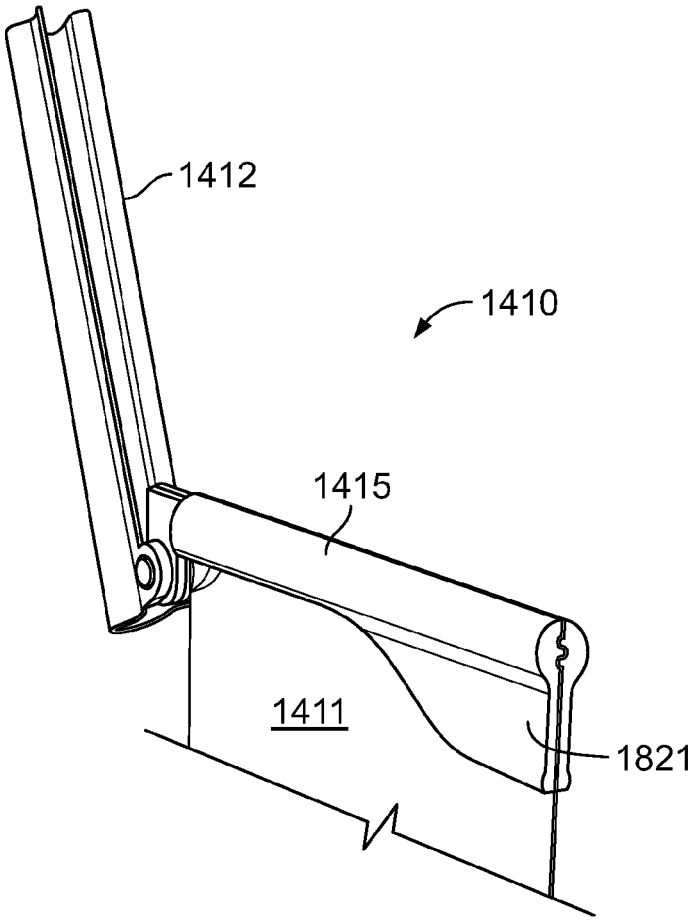
FIGS. 14A-14D show perspective details of an operable portion of a sealable compartment in accordance with embodiments of the invention.

In FIG. 14A, the compartment 1410 is shown with the over-clamp 1412 rotated into an open position. The pivot connection between the over-clamp 1412 and the closure rails 1415 may provide for 270° of rotation. In this regard, the compartment may further include a rivet or pin 1413 coupled to a pivot end of the over-clamp 1412 and to an end of the closure rails 1415. The illustrated pin 1413 provides an axis of rotation A-A for the over-clamp 1412 that is perpendicular to the major axis B-B of the opening of the pouch 1411. The external shaft of the pin 1413 may include indentations or spring-loaded protrusions that interact with the bore though which the pin 1413 is inserted in order to provide locking points that hold the over-clamp 1412 in either the open or closed position. Other locking techniques may also be used.

Figure 14B:
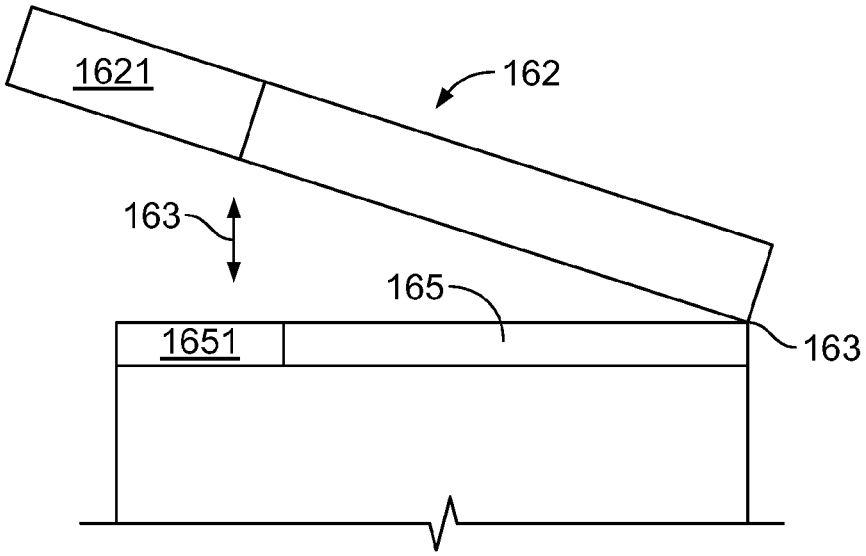
Figure 14D:
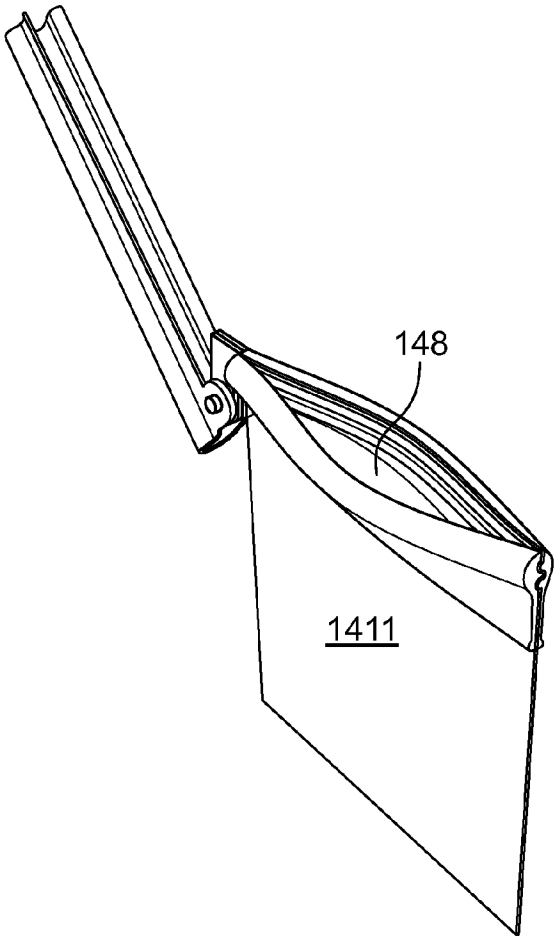
Figure 14C:
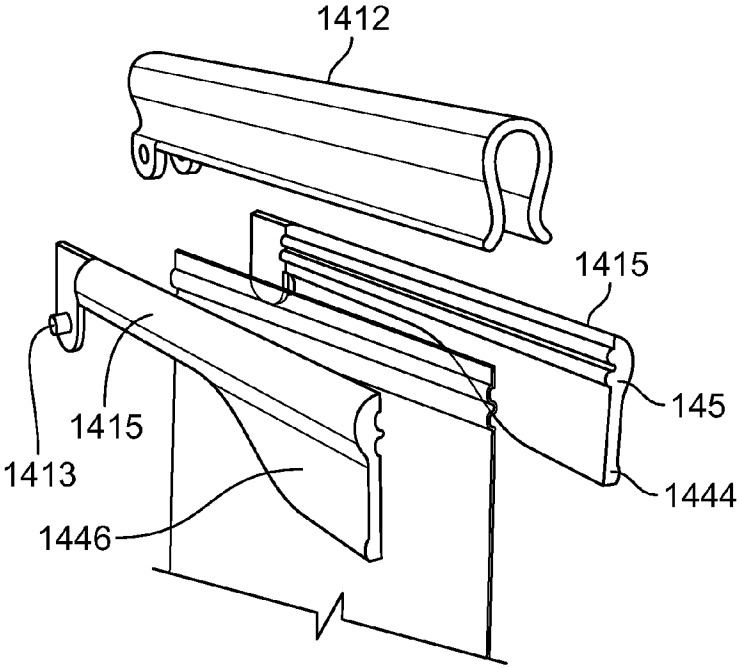

FIGS. 14C and 14D demonstrate that the closure rails 1415 may be constructed of a first rail and a second rail, wherein, if the over-clamp 1412 is rotated into the open position, the rails 1415 and 1415 can be flexed for access to the contents of the pouch 1411. As with other examples, the over-clamp 1412 and the closure rails 1415 may be made of the same or different materials. For example, the closure rails 1415 may utilize a plastic material that provides sufficient flexibility to open the pocket 1411 by applying light pressure to the ends of the closure rails 1415, and the over-clamp 1412 can include a plastic material that provides sufficient rigidity to the over-clamp 1412 to exert inward pressure on the rails when the over-clamp is in the closed position. In the case of a plastic construction, the over-clamp 1412 and closure rails may be formed in a plastic injection molding process, a blow molding process, or any other suitable process. The pouch 1411 may be formed in conjunction with their construction or afterwards.

Inside surfaces of the closure rails may be contoured to meet one another and outside surfaces may be heat welded to external surfaces of the pouch 1411. The pouch material may reach up into the area of the sealing profile of the rails or may not extend that far. In other words, when the rails are in a closed position, in some embodiments the rails may be touching along their length while in others, the rails may not touch as material of the pouches may provide the vast majority of contact area and sealing surfaces for the opening of the pouch. Consistent with the above, the external sides of the pouch 1411 may be fused together to form the sealed edges that define the pouch 1411. The inward surfaces of the first and second rails, can have sealing profiles that include the illustrated complementary scalloped shapes shown, in order to further enhance the quality of the seal.

Thus, in the illustrated example, the outward surface of the rails may mate with the inside surface of the over-clamp 1412 to form a seal for the compartment 1010, when the over-clamp 1412 is rotated into the closed position. Thus, the cross-section of the over-clamp 1412 and the closure rails can be of a shape that further improves their seal. For example, in the illustrated example, the over-clamp 1412 and closure rails 1415 have horseshoe shaped cross-sections, which increase the overall contact surface area and provide a pinching effect that strengthens the connection between the three pieces. The pinching effect can be further increased by adjusting the size of the over-clamp 1412 in relation to the closure rails 1415 so that the over-clamp 1412 is pressing inward when in the closed position. The illustrated first and second rails also include gripping regions 1444, 1446, respectively, that extend downward and provide greater surface area to facilitate opening and closing of the over-clamp 1412 away from the closure rails 1415.

FIG. 14B shows how the sealing profile 1621 and 1651 may be positioned on the outermost quartile of the over-clamp 162 and the closure rail 165. The arrow 163 shows how the over-clamp and the closure rail may pivot on end. This pivot may change and may not be positioned at the end, but may, instead, be located more towards the middle of the over-clamp and closure rail. In this example, only a portion of the over-clamp may swing away from the closure rails while a portion of the over-clamp remains on the closure rail. In this example, a third or more of the over-clamp may remain on the closure rails and not pivot away from them to provide access to the pouch. Still further, in embodiments, the over-clamp may not pivot on the closure rails but may be simply removed and snapped into place.

Figure 15:
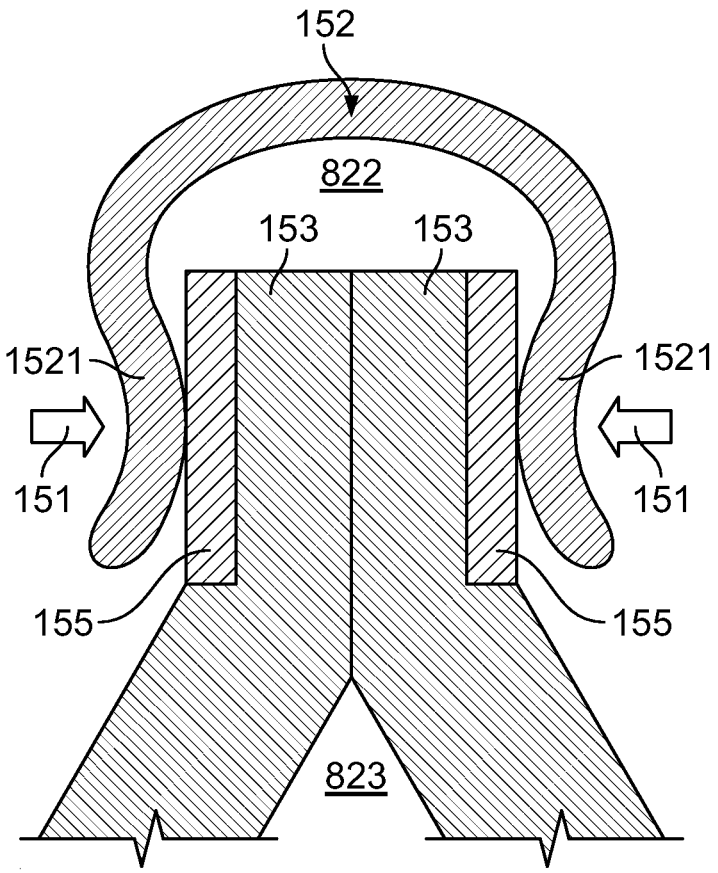
FIG. 15 shows a sectional view of an operable portion of a sealable compartment accord with embodiments of the invention.

FIG. 15 is an enlarged sectional view of the top portion of an embodiment of a sealable compartment. As can be seen in this embodiment the sealing profile 1521 of the over-clamp is curved while the closure rails 155 have flat surfaces. The inward biasing force imposed by the over-clamp 152 is shown by arrows 151. When the over-clamp is in position, as shown in FIG. 15, a void 822 may be present because the top of the over-clamp 152 may be larger than the width of the top of the pouch in order to facilitate improved placement and removal of the over-clamp. As can also be seen in FIG. 15, the pliable polymer material 153 may meet near the top of the pouch to form the seal for the pouch. The pliable poly material 153 may also be notched or otherwise designed to accommodate the closure rails, as shown in FIG. 15. The void for storing contents in the pouch is shown at 823. The rails in this embodiment may be parallel or may be bowed inwards along their length.

Figure 16B:
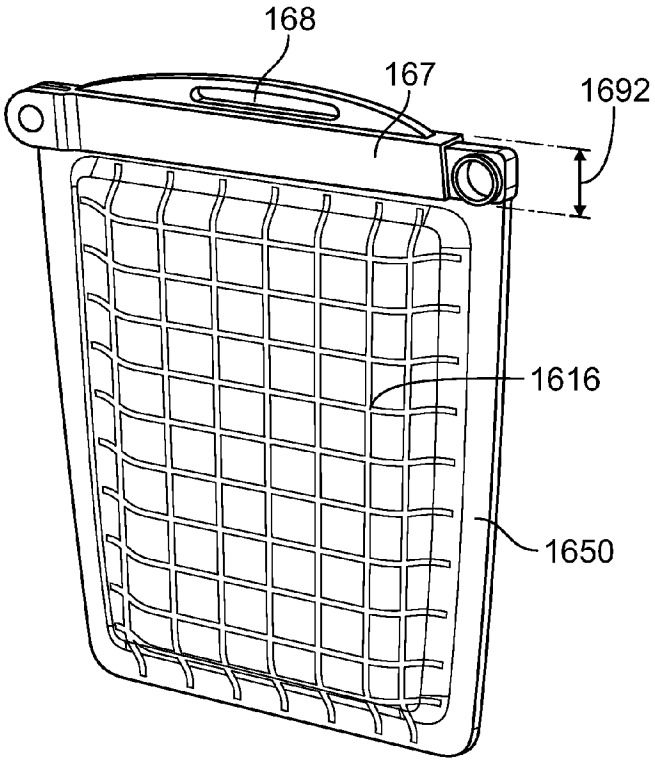
FIGS. 16A-16B show perspective views of a sealable compartment in an open and closed position in accordance with embodiments of the invention.
Figure 16A:
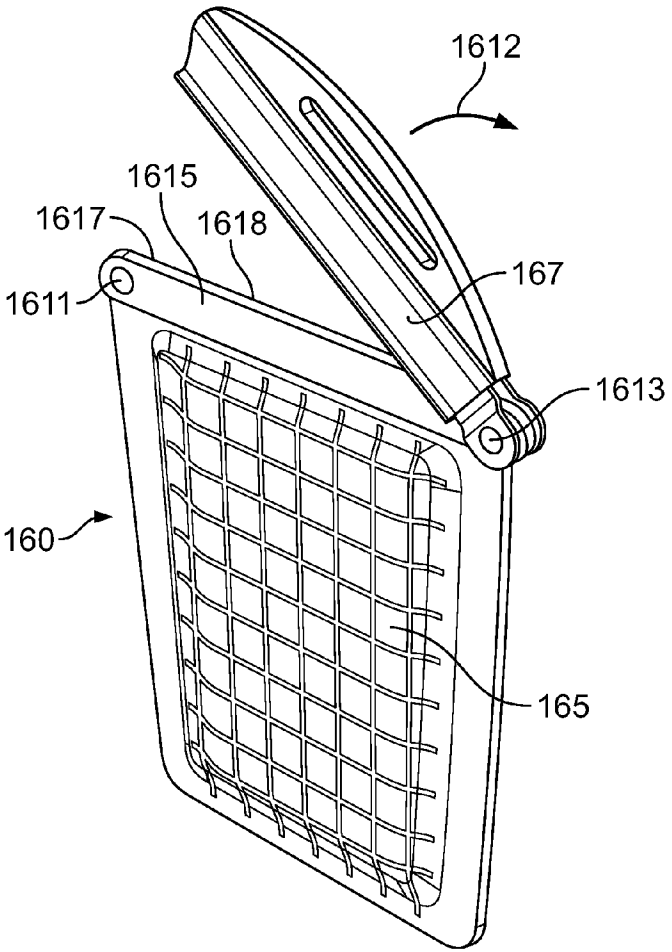

FIGS. 16A and 16B show a perspective view of an embodiment of a sealable compartment 160. As with other embodiments, this sealable compartment 160 may be used to store various items in a convenient and protected manner. The illustrated compartment 160, when closed, may also prevent or retard water from reaching the contents of the pliable pouch 165 if the compartment 160 were to be submerged to one or more atmospheres or were to simply get wet. Depending upon the contents placed in the compartment 160, and the makeup of the pliable pouch 165, the compartment 160 may even float in water when closed and even when open.

The sealable compartment 160 of FIG. 1 may be configured to include an over-clamp 167 having a handle space 168, lifting tab, and sealing profile. The sealable compartment 160 is also shown as containing two closure rails 1617 and 1615, a pivot 1613, extending out from ends of the closure rails, a carry/grab bore 1611 at an end of the closure rails, and a pliable pouch 165, with ribs 1616 and sealed edges 1650. The sealed edges 1650 may be positioned along three edges to form an enclosed space and an opening to access the space.

The material comprising the pliable pouch in this and other embodiments may include pliable polymers that may be injection molded during manufacture and may be later thermoset or welded together, along their edges, to form the three sealed edges 1650 of the pouch 165. Sonic welding as well as other suitable methods may be used to fuse the two sides of pliable polymer that may form the pouch 165. This pouch material is also preferably pliable and resilient in certain embodiments as the surfaces of the pouch may be used to form sealing surfaces near the opening of the pouch. These sealing surfaces may be held together such that they form a waterproof seal for the internal pouch space. Suitable polymers in these and other embodiments may include Hytrel® and Sanoprene® products sold by DuPont. Other polymers that may be used include TPU Elastolan-LP9291 sold by BASF, MPR-Alcryn 2060BK, sold by Ferro Corporation, and MPR-Alcryn 2060CL silicon sold by Momemtive.

Near the opening of the pouch 165, outside surfaces of the pliable polymer material comprising the pouch may be thermoset, welded, or otherwise connected to the closure rails 1615 and 1617. Having the closure rails on the outside of the pliable polymer can serve as a reinforcement to and protector of the opening of the pouch. In a closed position, the closure rails may contact the over-clamp 167, thus protecting the more pliable pouch material from repeated and potentially deleterious contact with the over-clamp. The rails may also be biased inwards by themselves due to their form or shape and they may alternatively or concurrently be also biased inwards by compressive forces exerted by the over-clamp. This bias may serve to apply a closure force along a portion of or the entire length of the rails 1615 and 1617.

Ribs 1616 may be formed on the surface of the pouch 165. These ribs 1616 may serve as polymer flow channels during the injection molding of the materials that comprise the sides of the pouch 165. These ribs 1616 may also serve as an additional cushion for contents in the pouch 165 as the ribs 1616 can serve to absorb energy, should the pouch be dropped or be impacted by something. In certain embodiments, the ribs may also be comprised of additional reinforcing material that can serve to prevent crushing of the pouch 165 in all directions or along certain directional paths. In other words, the pouch may offer different resistances to crushing depending upon where the loading is applied. The additional reinforcing material may be a composite material based reinforcement as well as a metal based reinforcement material. Other reinforcements may be used as well.

The closure rails 1615 and 1617 may be single injection molded plastic or solid resin plastic material. Other materials may be used as well. The closure rails may be straight, curved or have other configurations as well. Likewise, the closure rails may be fairly evenly spaced apart, may touch along their entire length, may be shaped as opposing concave sides, or may have other configurations as well. Exposed surfaces of the closure rails 1615 and 1617 may be contoured to provide a seating surface for the over-clamp 12. As a general matter, the surface of the closure rails may be firmer and offer less friction than the surface of the sides of the pouch 165, these properties can serve to reduce the effort needed to open and close the compartment. As also noted, the closure rails may be molded directly onto the sides of the pouch 165, near the opening of the pouch. The closure rails 1615 and 1617 may be welded with heat, sound, or some other method, to the sides of the pouch near the opening of the pouch 165.

As can be seen, there are two closure rails positioned at the top of the pouch in the embodiment of FIGS. 16A-16B. These closure rails have a pivot 1613 on one end and a carry/grab bore 1611 at the other end. In this embodiment, the over-clamp 167 sits over a substantial portion of the two closure rails such that only a small portion of the closure rails are visible in FIG. 16B.

FIG. 16B shows the sealable compartment 160 facing in the opposite direction of FIG. 16A. As can be seen, the sides of the compartment 160 may be fairly symmetrical. The swinging nature of the over-clamp 167 is evident in FIG. 16A. Also visible in FIG. 16A is the groove 1618, which is atop the two closure rails. When opening the compartment 160, to gain access to the pouch 165, the groove 1618 may provide a gripping area to allow the closure rails to be separated from each other along their length. Once separated, access to the pouch 165 is possible and contents can be added or removed from the pouch as needed. As can be seen, the carry/grab bore 1611 may be used to carry the compartment 160. The compartment 160 may be attached to active-wear and active-gear by sewing, stitching or other methodology.

Figure 17B:
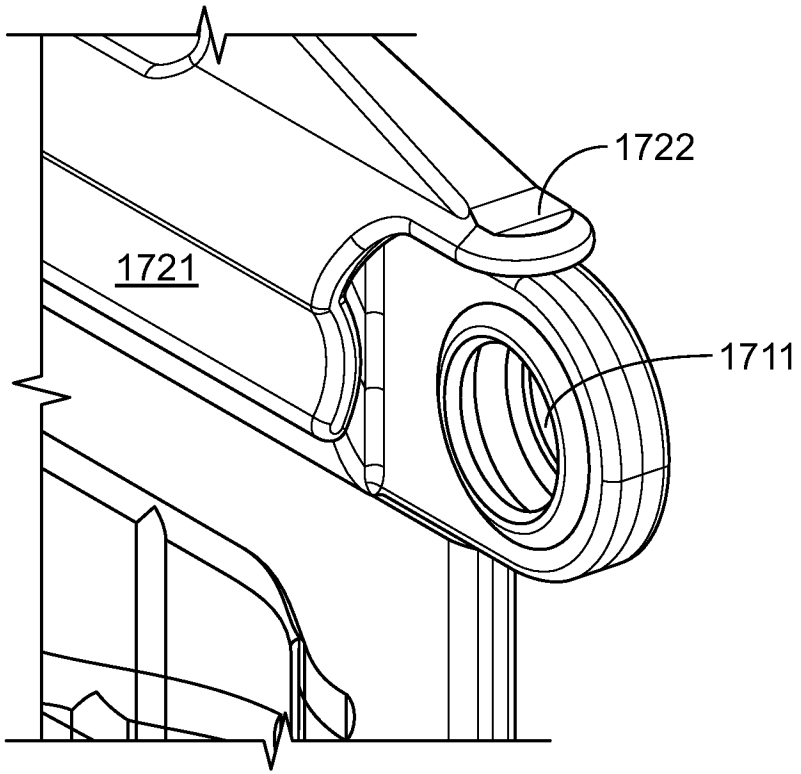
FIGS. 17A-17C show perspective views of operable portions of a sealable compartment in accordance with embodiments of the invention.
Figure 17A:
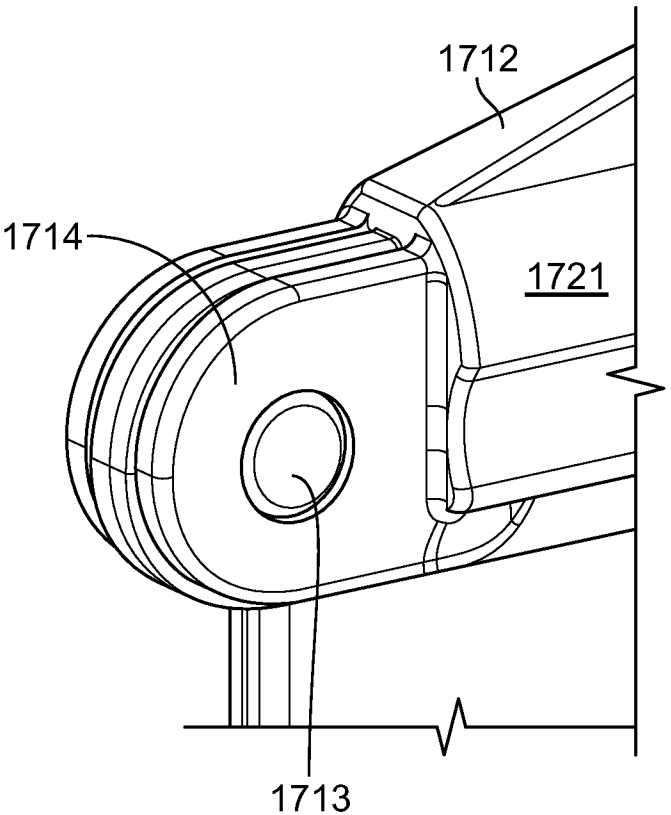
Figure 17C:
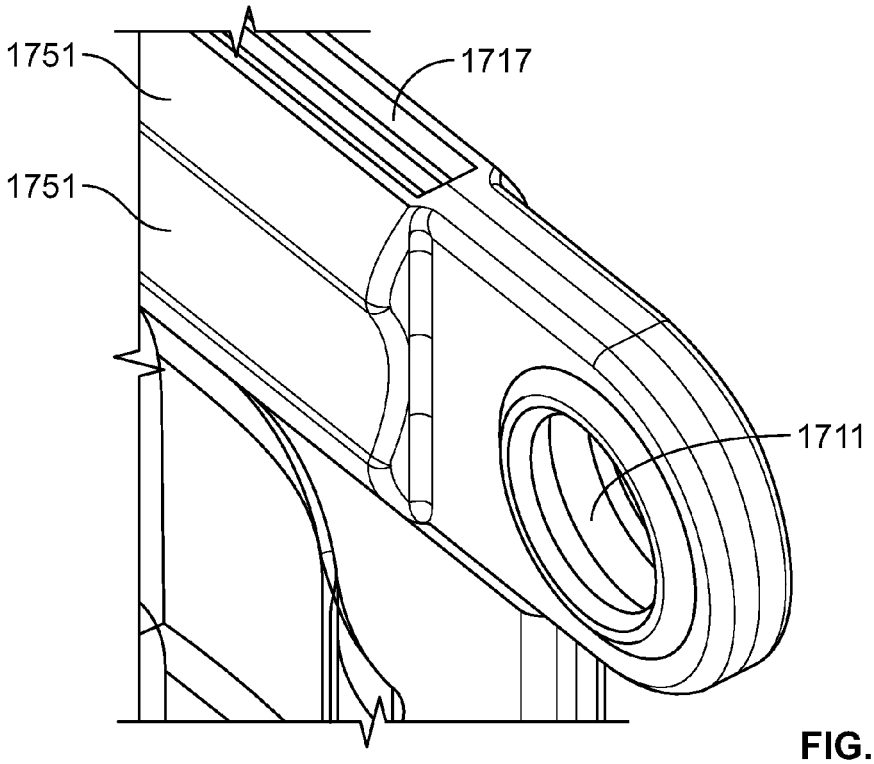

FIGS. 17A-17C show close-up perspective views of the ends of closure rails. FIG. 173 shows the end of a closure rail near the carry/grab bore 1711 and FIGS. 17A-17B show the closure rails with the over-clamp 1712. The groove 1717 and sealing profiles 1751 of the closure rails can be seen in FIG. 17C. The sealing profile 1751 may provide a seating surface upon which the over-clamp 1712 may become aligned with when the over-clamp 1712 is in a closed position. The sealing profile 1751 can also serve to hold the over-clamp 1712 in a closed position.

As can be seen in FIG. 17C, the sealing profile 1751 has a raised peak section and a concave section. When the over-clamp 1712 is pushed over this raised peak, the clamp 1712 will be spread apart, then as the clamp 1712 travels further down and reaches the concave section, the clamp 1712 will return back to be seated and aligned with the concave section of the sealing profile 1751. In this seated position, which is shown in both FIG. 17A and FIG. 17B, the over-clamp 1712 may exert inward pressure on the closure rails, which in turn exert inward pressure on the pliable polymer material of the pouch to maintain a waterproof seal.

FIG. 17A shows the sealing profile of the over-clamp 1712 as well as the over-clamp pivot end 1714. The pivot 1713, which is a raised barrel on the end of the closure rails, is also visible in FIG. 17A. The end of the over-clamp 1712 has an opening sized to accept the pivot 1713, and to turn about the pivot 1713. In some embodiments, the over-clamp 1712, when pivoting on the pivot 1713, will mimic the blade of a hinged desktop paper cutter, moving from an open position to a closed position with more and more of the over-clamp and closure rails contacting one another as the over-clamp is pushed down. Like the closure rails, the over-clamp has a sealing profile 1721 with a raised peak section and a concave section. The dimensions of the over-clamp may mimic those of the closure rails such that the over-clamp 1712 can snap into position when it is seated and apply a biasing force to the closure rails to keep the rails forced inwards, and closed. This biasing force may be applied uniformly across the length of the closure rails as well as in more targeted areas to account for specific rail configurations or specific uses that may require increased closing forces at one end or another. In each event, the over-clamp 1712 may remain in an expanded state when seated on the closure rails 1712. By so doing, a positive bias may be maintained on the closure rails to better improve the performance of the seal on the pouch.

FIG. 17B shows the opposite end of the over-clamp 1712 and closure rails from what is shown in FIG. 17A. The lifting tab 1722 is visible in FIG. 17B. This tab 1722 may be used to pry the over-clamp 1712 away from the closure rails. The tab may also be used for pressing the over-clamp down and over the closure rails. The sealing profile of the closure rails and the sealing profile of the over-clamp may run the length of each. However, as shown in FIG. 14B, the sealing profiles may also run only a portion of the length of each. In one embodiment, the sealing profiles may be at the further quarter of length of the over-clamp and the closure rails. Positioning the sealing profiles in this fashion can serve to increase the ease in which the over-clamp may be placed in the closed position without compromising much if any inward biasing force on the closure rails.

Figure 18:
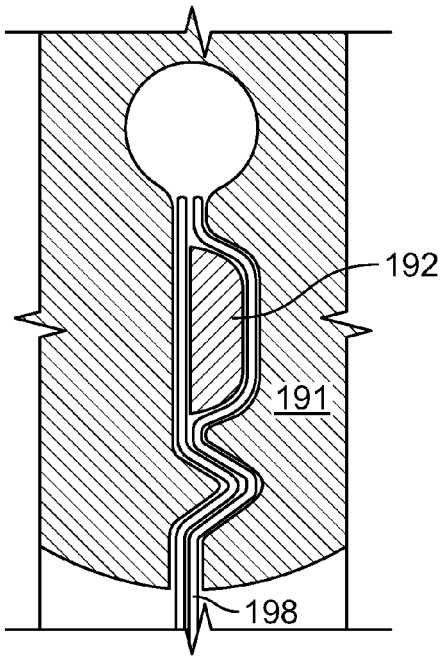
FIG. 18 show an enlarged cross section of closure rails of a sealable compartment in accordance with embodiments of the invention.
Figure 19:
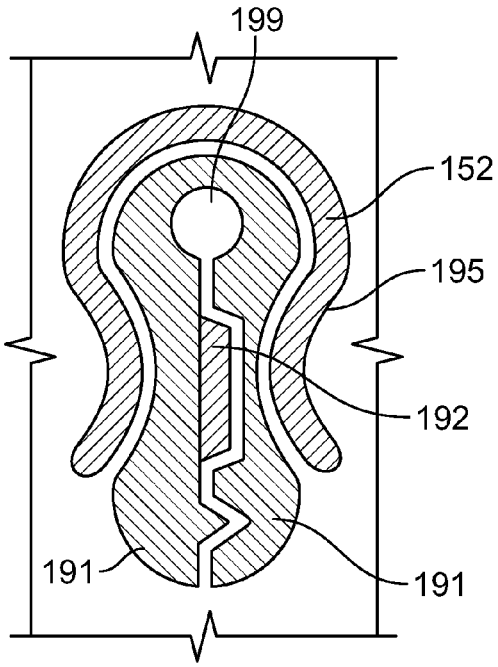
FIG. 19 show an enlarged cross section of closure rails and an over-clamp of a sealable compartment in accordance with embodiments of the invention.

FIGS. 18 and 19 show sectional views of over clamp and closure rails in accord with embodiments of the invention. The over clamp 152 is shown having a sealing profile 195 in FIG. 19. Within the over clamp 152 are connected closer rails 151 having a meeting profile in involving a groove and notched configuration. Within the closure rails 191 is a pliable couch 198. This pliable couch is visible in FIG. 18. Assisting in sealing the pliable patch is a sealing rail 192. The sealing rail may be placed between layers of the pliable couch such that when the closure rails are contacted or compressed towards each other the pliable couch may seal against the sealing rails 192. Thus in this embodiment the over clamp and the closure rails share a sealing profile having concave and convex surfaces. As can also be seen, near the connection point of the closure rails 191, is a void. This void 199, may help facilitate the opening closing of the closure rails.

Figure 20A:
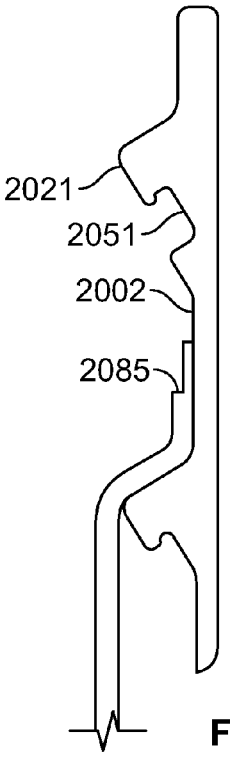
FIGS. 20A-20E show closure rails and a pouch as may be used in a sealable compartment in accordance with embodiments of the invention.
Figure 20B:
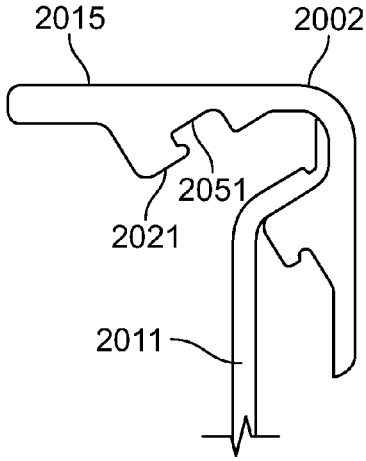
Figure 20C:
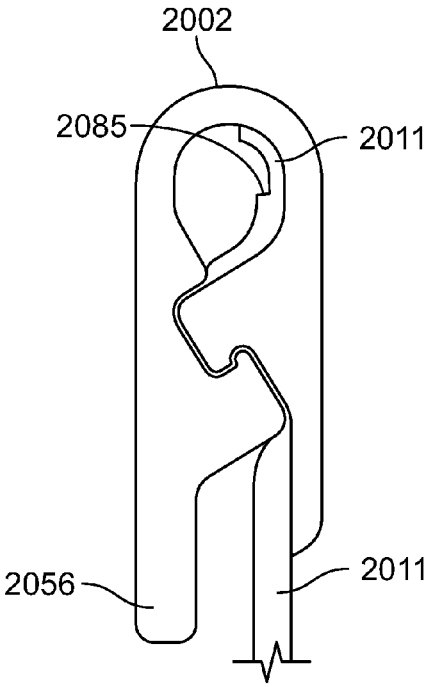
Figure 20D:
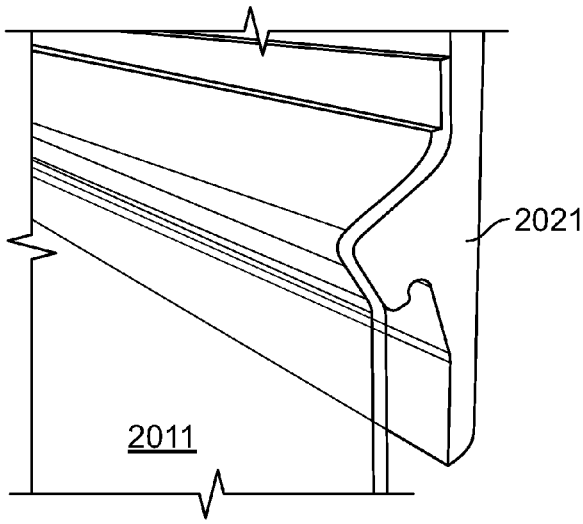
Figure 20E:
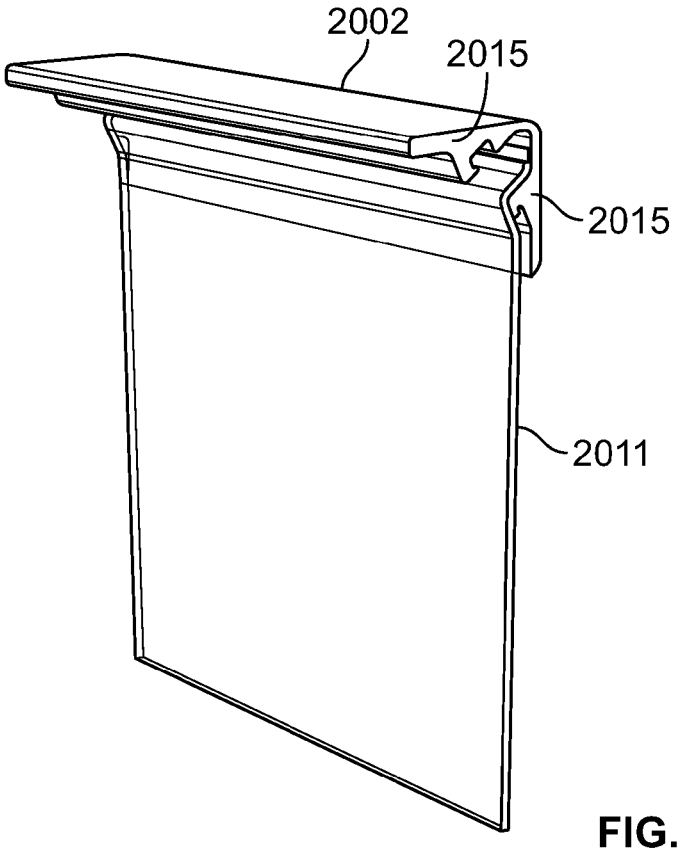

FIGS. 20A-20E show further features of embodiments of a sealable compartment in accord with embodiments. As can be seen, the closure rails 2015 are linked together along their length and no over-clamp is used. As can be seen, the closure rails 2015 may include sealing profiles 2021 and the closure rails may be welded or thermoset to the pouch 2011. The pouch 2011 may have an opening 2085 along the top surface where the edges of the pouch have not been sealed shut. This opening 2085 may be held shut when the closure rails 2015 are closed and locked in place. FIG. 20C shows the closure rails 2015 in a locked position while FIG. 20B shows the closure rails 1415 in an open position. As the rails are closed, the pouch may be lifted up and into the sealing profiles 2021. In an embodiment, the width of the pouch material is preferably thin enough and flexible enough to fit within and between the sealing profiles 2021 of the closure rails 2015 when the closure rails are in a closed position. When the pouch needs to be opened, the gripping tab 2056 can be lifted up and away, in an unzipping fashion. Likewise, when the closure rails are closed it may be efficient to close them together in a zipping fashion. The thickness of the pouch 2011 may change as it may be thicker below the closure rails 2015 then in the area adjacent to and near the closure rails 2015. In certain embodiments, this change in thickness may be accomplished by using composite material for the pouch 2011 or different materials for the top and bottom of the pouch. This may include using materials with high shear strength near the rails 2015 and more pliable and thicker material for the pouch 2011 below the rails 2015.

The linking strip 2002 may provide an axis of rotation for the two closure rails 2015 that is longitudinal to the major axis of the opening of the pouch 2011. As best seen in FIGS. 20A-20C, the illustrated closure rails 2015 have interlocking male-female sealing profiles 2021, 2051, which connect with one another and provide a water resistant seal for the pouch 2011 when the rails are closed.

FIG. 20B also shows that an upper portion or edge of the pouch 2011 can be welded or otherwise coupled to one of the closure rails 2015 such that the pouch 2011 may hang loose downward from the closure rails 2015. Accordingly, the front side of the pouch 2011 may end (e.g., have a top opening 2085) at a middle region of one of the closure rails 2015 to provide access to the contents of the pouch 2011 when the rails are in an open position.

The linking strip 2002 may have a wide variety of shapes and constructions depending upon the circumstances. For example, the linking strip could have a thinner cross-section to enable the material to flex where desired and decrease the resistance experienced by the user. Likewise, the linking strip could have longitudinal grooves, which are not shown, to achieve the desired flexibility.

In embodiments, the closure rails may have internal grooves shaped as crevices, plateaus, and pointed buttes. Likewise, gripping tabs 2056 may have other shapes as well.

The pouch may employ various end finishing systems to seal it. Moreover, the pouch may be made from sheets of material that are welded or otherwise attached to form the pouch. The edge of the inner sheet shows a bead of welding material prior to it interfacing with the outer pouch sheet.

Figure 21A:
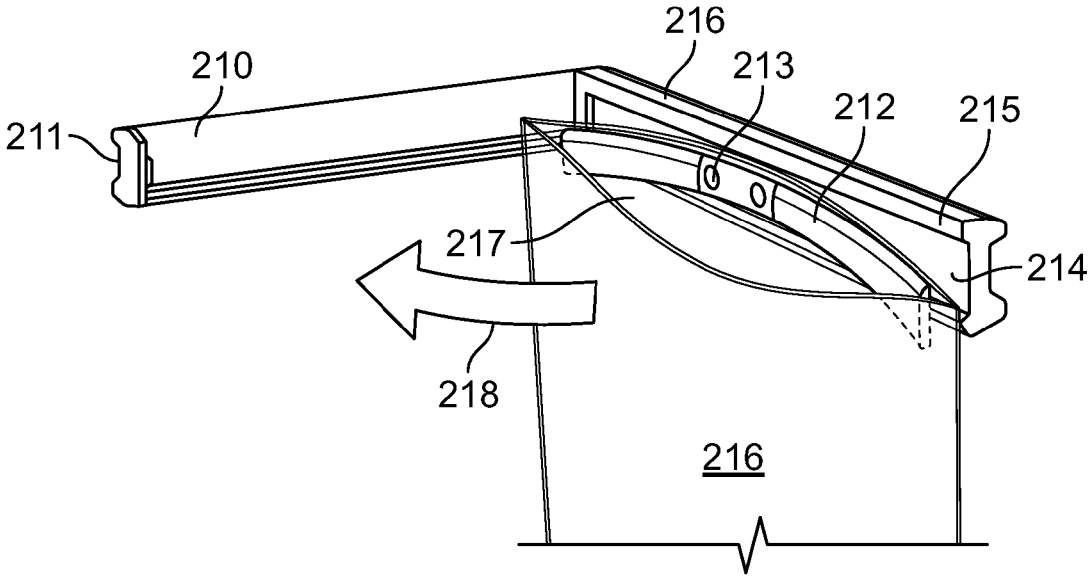
FIGS. 21A-21C show operable portions of a sealable compartment in accordance with embodiments of the invention.
Figure 21B:
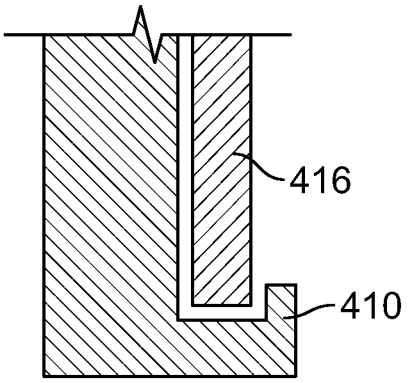
Figure 21C:
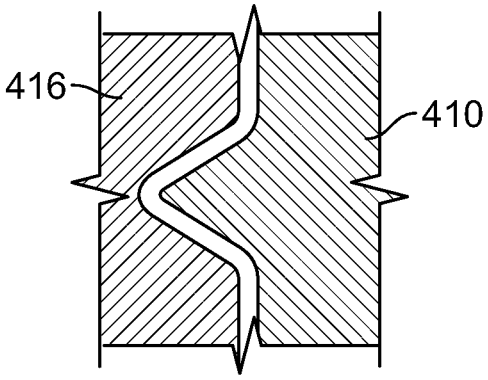

FIG. 21A shows that the sealing surface 212 may be spring loaded and extend away from the sealing bars to create an opening in the pouch 216. FIG. 21A also shows that the closure rails 210 and 216 may be end-pivoting rather than top-pivoting. Also visible in FIG. 21A are end 211 of closure rail 210, circle 213, middle inside 214 of closure rail 216, upper inside 215 of closure rail 216, opening 217, and arrow 218. FIG. 21B and 21C show sectional views of closure rails 416 and 410.

In embodiments, in addition to the foregoing other modifications and combination of features, methods, and manufacture of the sealable compartment may also be made. These changes can include having a sealing surface positioned within and between a pouch and closure rails to facilitate a seal and closure of the pouch. In so doing, the clamp profile of the over-clamp may serve to exert extra closing force on the closure rails. Furthermore, the closure rails may have additional features and different configurations, for example, the rails may have a middle tab may be present on the closure rails and the over-clamp may have a bowed middle to accommodate the middle tab. Still further, the gasket may also have various configurations and designs. it may contain additional or different grooves and notches that may be equidistant or have variable spacing and may be in the shape of a "V" or "U" as well as having a keyed sectional profile.

In embodiments, the closure rail and pouch may be formed together and be made integral with one another. The grooves may serve to increase the ease in which the closure rails may be closed and may serve to control the distance and orientation as to how the closure rails may open from one another. The closure rails may be padded or thicker than in other embodiments to facilitate positioning of the grooves. The grooves in the closure rails may facilitate movement and expansion of the closure rails much in the same fashion as a wristband of a wrist watch. In other words, the grooves would expand near the top, when the band was bowed or stretched and retract back to a normal size when the closure rails are released back to a normal resting position.

The sealable compartments in the embodiments described and taught herein, as well as others that are consistent with these teachings, may withstand water entry into a sealed compartment or pouch at water pressures up to substantially 25 PSI or more. Embodiments may also be designed to withstand less pressure in certain embodiments where other design criteria are more important that PSI loading. For example, where pouch flexibility is important, the material comprising the pouch may only be waterproof to approximately 15 PSI, which can be acceptable in certain application. Conversely, in other applications, the compartment may be bolstered to withstand pressures in excess of 100 PSI or more, as may be necessary in deep diving support gear. In each embodiment, the waterproof materials may prevent the passage of water for a specified design/submersion time. For example, contents may remain dry for 30 minutes at pressures up to 200 PSI, for 60 minutes at pressures up to 100 PSI.

Figure 22:
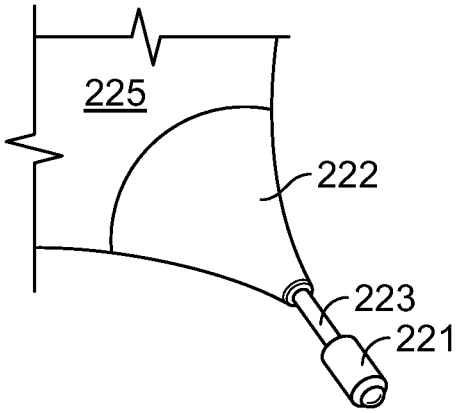
FIG. 22 shows a perspective view of a sealing tip as may be employed in a sealable compartment in accordance with embodiments of the invention.

FIG. 22 shows an enlarged section of a corner of a pliable couch as may be employed in accord with embodiments of the invention. Access port 222 is shown with stop 221 and pull 223. The stop and pull may be pushed and pulled in order to gain access to the access port 222 and to the pliable pouch 225. In the extended position shown in FIG. 2 fluid may be stopped from entering or exiting the pliable pouch 225. Comparatively, when the stop 221 is pushed towards the access port 222, fluid and/or gas may enter and exit the pliable pouch to 225.

Embodiments may be used in various applications where high performance standards apply. Water proof seals may be maintained in various conditions. Other uses are also applicable. Embodiments may be designed to integrate into clothing or medical device carriers. Embodiments may be used for other reasons as well.

From the foregoing description, various embodiments of the invention may be evident. This includes modifying the individual embodiments, combining elements across embodiments, and adding or deleting elements consistent with the foregoing teachings. Therefore, while the embodiments of this invention have been described in connection with particular examples thereof, the true scope of the embodiments of the invention should not be so limited since other modifications will become apparent to the skilled practitioner upon a study of the drawings, specification, and following claims.

We claim:

1. A portable sealable enclosure comprising:
- a pouch of waterproof material,
  - the pouch having an opening for accessing an internal pocket defined by the waterproof material;
  - the pouch having a sealing profile;
- a gasket positioned within the sealing profile;
- a latch body extending through the gasket and the sealing profile of the pouch;
- a toggle clamp movable from an open position to a closed position, when in the closed position the toggle clamp exerting a sealing force on the latch body, the sealing force being transferred by the latch body to the sealing profile of the pouch;
- a first overclamp; and
- a second overclamp;
- the first overclamp movably connected to the second overclamp,
- the first overclamp and the second overclamp applying sealing pressure to the gasket when the toggle clamp is in a closed position.

2. The portable sealable enclosure of claim 1 wherein the toggle clamp has a pawl applying sealing pressure to the latch body when the toggle clamp is in a closed position.

3. The portable sealable compartment of claim 1 wherein the sealing profile of the pouch forms a waterproof seal with the gasket when the toggle clamp is in a closed position.

4. The portable sealable compartment of claim 1
- wherein the first overclamp has an opening through which the latch body may pass though,
- wherein the pouch sealing profile has an opening sized to receive the latch body,
- wherein the pouch sealing profile defines a space for receiving the gasket,
- wherein the gasket defines a space for receiving the latch body,
- wherein the toggle clamp pivots on a pin coupled to an overclamp, and
- wherein the latch body has arms that extend through the gasket and the pouch sealing profile and at least one overclamp.

5. The portable sealable compartment of claim 1 wherein the first overclamp and the second overclamp are movably connect to each other with a hollow hinge, the hollow hinge having a channel within the hinge, the channel extending along a length of the hinge.

6. The portable sealable compartment of claim 1 wherein the first overclamp, the second overclamp, the gasket, and the pouch sealing profile have outside borders that mimic each other.

7. The portable sealable compartment of claim 1 wherein the gasket includes one or more sealing profiles and a compression zone void, the volume of the compression zone void shrinking when the toggle clamp is in a closed position.

8. The portable sealable compartment of claim 1 wherein the pouch has a control panel, the control panel including a connection port, the connection port configured to allow electronic communication to or from a device placed in the pouch.

9. The portable sealable compartment of claim 1 wherein the first overclamp and the second overclamp form a horseshoe cross-section and have a sealing profile.

10. The portable sealable compartment of claim 1 wherein the toggle clamp has a pawl, a locking tab, a lifting tab, and wherein the pawl is in the shape of an elongated D.

11. The portable sealable compartment of claim 1 wherein the sealing profile of the pouch has one or more alignment openings, the latch body positioned in one or more of the alignment openings.

12. The portable sealable compartment of claim 1 wherein the opening of the pouch is biased in an open position.

* * * * *